US010799028B2

(12) United States Patent
Deisig et al.

(10) Patent No.: US 10,799,028 B2
(45) Date of Patent: Oct. 13, 2020

(54) CHAIRS INCLUDING FLEXIBLE FRAMES

(71) Applicant: HNI Corporation, Muscatine, IA (US)

(72) Inventors: Wolfgang Deisig, Berlin (DE); Nils Koehn, Berlin (DE); Jay Richard Machael, Muscatine, IA (US); Douglas A. Schroeder, Muscatine, IA (US)

(73) Assignee: NHI Corporation, Muscatine, IA (US)

( * ) Notice: Subject to any disclaimer, the term of this patent is extended or adjusted under 35 U.S.C. 154(b) by 0 days.

(21) Appl. No.: 16/100,744

(22) Filed: Aug. 10, 2018

(65) Prior Publication Data

US 2019/0045934 A1 Feb. 14, 2019

Related U.S. Application Data

(60) Provisional application No. 62/543,712, filed on Aug. 10, 2017.

(51) Int. Cl.
*A47C 7/44* (2006.01)
*A47C 7/14* (2006.01)
(Continued)

(52) U.S. Cl.
CPC ..... *A47C 7/443* (2013.01); *A47C 1/024* (2013.01); *A47C 7/14* (2013.01); *A47C 7/144* (2018.08);
(Continued)

(58) Field of Classification Search
CPC ..... A47C 7/44; A47C 7/441; A47C 7/443; A47C 7/444; A47C 7/445; A47C 7/4454;
(Continued)

(56) References Cited

U.S. PATENT DOCUMENTS 809,944 A 1/1906 Hanger
2,807,310 A 9/1957 Sellner
(Continued)

FOREIGN PATENT DOCUMENTS

EP 0196819 A2 10/1986
EP 0309368 A1 3/1989
(Continued)

OTHER PUBLICATIONS

International Search Report and Written Opinion issued in PCT/US2013/056918, dated Dec. 2, 2013, 18 pages.
(Continued)

*Primary Examiner* — Kyle J. Walraed-Sullivan
(74) *Attorney, Agent, or Firm* — Faegre Drinker Biddle & Reath LLP

(57) ABSTRACT

A chair includes a support spine. A seat assembly is coupled to the support spine, and the seat assembly includes a flexible frame being movable relative to the support spine. The flexible frame comprises a first frame element, a second frame element coupled to the first frame element at a first corner, and a third frame element coupled to the second frame element at a second corner. The first corner and the second corner are substantially independently movable relative to the support spine. A conformable panel is coupled to the flexible frame and configured to engage an occupant of the chair. A resistance assembly couples the support spine to the flexible frame. The resistance assembly bears against the flexible frame to facilitate substantially independent movement of the first corner and the second corner relative to the support spine.

8 Claims, 13 Drawing Sheets

(51) Int. Cl.
*A47C 1/024* (2006.01)
*A47C 7/34* (2006.01)

(52) U.S. Cl.
CPC ..... *A47C 7/34* (2013.01); *A47C 7/44* (2013.01); *A47C 7/445* (2013.01)

(58) Field of Classification Search
CPC ..... A47C 7/446; A47C 7/448; A47C 7/144; A47C 7/34; A47C 7/342; A47C 7/345; A47C 7/347; A47C 7/35; B60N 2002/0216; B60N 2002/022; B60N 2002/1839
See application file for complete search history.

(56) References Cited

U.S. PATENT DOCUMENTS 2,921,622 A 1/1960 Henrickson et al.
3,111,344 A 11/1963 Hoven et al.
3,331,578 A * 7/1967 Esposito ..... A47C 7/34 248/575
3,393,941 A 7/1968 Grossfillex
3,934,932 A 1/1976 Ekornes
4,046,422 A 9/1977 Ambasz
4,084,850 A 4/1978 Ambasz
4,157,203 A 6/1979 Ambasz
4,379,589 A 4/1983 Marino
4,585,272 A 4/1986 Ballarini
D289,120 S 4/1987 Chadwick et al.
4,709,962 A 12/1987 Steinmann
4,733,910 A 3/1988 Brennan
D296,394 S 6/1988 Chadwick et al.
D299,192 S 1/1989 Chadwick et al.
4,856,846 A 8/1989 Lohmeyer
4,880,273 A 11/1989 Markus
4,913,493 A 4/1990 Heidmann
4,979,778 A 12/1990 Shields
4,981,326 A 1/1991 Heidmann
4,984,846 A 1/1991 Ekornes
5,076,646 A 12/1991 Matte
5,102,196 A 4/1992 Kaneda et al.
5,244,252 A 9/1993 Serber
5,251,958 A 10/1993 Roericht et al.
5,303,978 A 4/1994 Murrey
5,314,237 A 5/1994 Koepke et al.
5,338,094 A 8/1994 Perry
5,340,197 A 8/1994 Vogtherr
5,383,712 A 1/1995 Perry
5,486,035 A 1/1996 Koepke et al.
5,522,182 A 6/1996 Rogers
5,558,399 A 9/1996 Serber
5,597,203 A 1/1997 Hubbard
5,599,069 A 2/1997 Lorbiecki
5,611,598 A 3/1997 Knoblock
5,660,439 A 8/1997 Unwalla
5,713,632 A 2/1998 Su
5,725,277 A 3/1998 Knoblock
5,735,574 A 4/1998 Serber
5,782,536 A 7/1998 Heidmann et al.
5,785,384 A 7/1998 Sagstuen
5,806,930 A 9/1998 Knoblock
5,810,438 A 9/1998 Newhouse
5,909,923 A 6/1999 Dekraker
5,957,534 A 9/1999 Wilkerson et al.
5,979,984 A 11/1999 Dekraker et al.
6,056,361 A 5/2000 Cvek
6,070,937 A 6/2000 Ginat
6,109,696 A 8/2000 Newhouse et al.
6,257,665 B1 * 7/2001 Nagamitsu ..... A47C 7/405 297/285
6,435,615 B1 8/2002 Zapf
6,533,352 B1 3/2003 Glass et al.
6,554,360 B1 4/2003 Wilke et al.
6,572,190 B2 * 6/2003 Koepke ..... A47C 1/03255 297/284.1
6,641,214 B2 11/2003 Veneruso
6,722,735 B2 4/2004 Lucci et al.
6,739,663 B2 5/2004 Gevaert
6,739,665 B1 5/2004 Leib et al.
6,779,846 B2 8/2004 Spendlove et al.
6,786,548 B2 9/2004 Pearce et al.
6,923,503 B2 8/2005 Sangiorgio
6,935,690 B2 8/2005 Lucci et al.
6,986,549 B2 1/2006 Kniese
7,004,543 B2 2/2006 Caruso et al.
7,073,860 B2 7/2006 Markus
7,073,864 B2 7/2006 Olsen
7,114,777 B2 10/2006 Knoblock et al.
7,114,782 B2 10/2006 Ambasz
7,118,177 B2 10/2006 Piretti
7,226,127 B1 * 6/2007 Yevko ..... A47C 7/44 297/284.1
7,234,774 B2 6/2007 Heidmann et al.
7,249,802 B2 * 7/2007 Schmitz ..... A47C 1/03255 297/284.4
7,334,842 B1 2/2008 Wu
7,360,835 B2 4/2008 Tubergen et al.
7,472,962 B2 1/2009 Caruso et al.
D587,915 S 3/2009 Igarashi
D599,125 S 9/2009 Piretti
7,611,202 B2 11/2009 Johnson et al.
7,621,600 B2 11/2009 Buchbinder
7,686,395 B2 3/2010 Piretti
7,695,067 B2 4/2010 Goetz et al.
D618,004 S 6/2010 DeSanta et al.
D661,504 S 6/2012 Saotome
10,383,446 B2 * 8/2019 Schmitz ..... A47C 7/44
2002/0158500 A1 * 10/2002 Chu ..... A47C 1/03 297/411.36
2002/0190553 A1 * 12/2002 Koepke ..... A47C 1/03255 297/300.2
2003/0107252 A1 * 6/2003 Kinoshita ..... A47C 3/12 297/301.1
2004/0140701 A1 * 7/2004 Schmitz ..... A47C 7/44 297/284.4
2005/0161990 A1 7/2005 Piretti
2007/0063563 A1 3/2007 Maze et al.
2007/0108819 A1 * 5/2007 Ueda ..... A47C 7/443 297/292
2007/0108820 A1 * 5/2007 Ueda ..... F16F 1/22 297/300.5
2007/0108831 A1 * 5/2007 Ueda ..... A47C 1/03255 297/452.29
2007/0126271 A1 6/2007 Brodeur
2008/0272636 A1 * 11/2008 Machael ..... A47C 7/46 297/284.4
2009/0102268 A1 4/2009 Schmitz et al.
2009/0195040 A1 8/2009 Birkbeck
2009/0261644 A1 10/2009 Piretti
2012/0274111 A1 11/2012 Piretti
2013/0020849 A1 * 1/2013 Hsuan-Chin ..... A47C 7/44 297/307
2013/0082499 A1 * 4/2013 Schmitz ..... A47C 1/03255 297/285
2014/0062154 A1 3/2014 Minino et al.
2015/0164232 A1 * 6/2015 Mezzera ..... A47C 7/46 297/284.4
2017/0354254 A1 * 12/2017 Diffrient ..... A47C 3/026
2018/0022238 A1 * 1/2018 Gonzalez Uribe ..... B60N 2/66 297/325

FOREIGN PATENT DOCUMENTS

EP 1785068 A1 5/2007
EP 2110051 A1 10/2009
EP 2910148 A1 8/2015
JP 07155232 A 6/1995
JP 2003-265256 * 9/2003 ..... A47C 1/024
WO 2009039231 A2 3/2009

OTHER PUBLICATIONS

(56) References Cited

OTHER PUBLICATIONS

International Search Report and Written Opinion issued in PCT/US2018/046230, dated Oct. 30, 2018, 11 pages.
Partial International Search Report issued in PCT/US2013/056918, dated Oct. 10, 2013, 5 pages—(document named: PartialSR_056918).

* cited by examiner

CHAIRS INCLUDING FLEXIBLE FRAMES

CROSS-REFERENCE TO RELATED APPLICATION

The present application claims the benefit of and priority to, under 35 U.S.C. § 119(e), U.S. Provisional Application Ser. No. 62/543,712, filed Aug. 10, 2017, entitled CHAIRS INCLUDING FLEXIBLE FRAMES, which is hereby incorporated by reference in its entirety for all purposes.

TECHNICAL FIELD

The present invention relates to chairs including mesh back and/or seating surfaces that conform to the shape of an occupant's body.

BACKGROUND

Chairs including mesh back and/or seating surfaces are used in various environments (for example, office settings) to facilitate occupant comfort and productivity. However, such chairs typically include relatively stiff frame components to support the mesh back and/or seating surfaces. Such frame components can cause occupant discomfort, for example, when the occupant moves while seated (for example, to change seated postures, perform office tasks, stretch, or the like).

SUMMARY

In a first example, a chair includes a support spine; a seat assembly coupled to the support spine, the seat assembly including: a flexible frame being movable relative to the support spine, the flexible frame including a first frame element, a second frame element coupled to the first frame element at a first corner, and a third frame element coupled to the second frame element at a second corner, the first corner and the second corner being substantially independently movable relative to the support spine; a conformable panel coupled to the flexible frame and configured to engage an occupant of the chair; and a resistance assembly coupling the support spine to the flexible frame, the resistance assembly bearing against the flexible frame to facilitate substantially independent movement of the first corner and the second corner relative to the support spine.

In a second example, the first frame element of the first example includes a first flexible section, the second frame element includes a second flexible section, and the third frame element includes a third flexible section.

In a third example, the resistance assembly of any of the previous examples includes a compression spring.

In a fourth example, the resistance assembly of the third example further includes a slider translatably coupled to the support spine, the slider being urged to translate relative to the support spine by the compression spring; and a connecting link pivotably coupled to the slider and coupled the flexible frame.

In a fifth example, the resistance assembly of the third example further includes a first connecting link pivotably coupled to the support spine; and a second connecting link translatably coupled to the first connecting link and coupled the flexible frame, the second connecting link being urged to translate relative to the first connecting link by the compression spring.

In a sixth example, the resistance assembly of any of the previous examples includes a leaf spring.

In a seventh example, the resistance assembly of the sixth example further includes a connecting link pivotably coupled to the leaf spring and coupled to the flexible frame.

In an eighth example, the resistance assembly of the seventh example further includes a stiffness adjustment component movable along the leaf spring to facilitate adjustment of a bending stiffness of the leaf spring.

In a ninth example, the resistance assembly of any of the previous examples includes a flexible arm having a dog legged shape.

In a tenth example, the seat assembly of any of the previous examples includes a back configured to engage the back of the occupant, the back including the flexible frame and the conformable panel.

In an eleventh example, the seat assembly of any of the first example through the ninth example includes a seat configured to engage the legs of the occupant, the seat including the flexible frame and the conformable panel.

In a twelfth example, a chair includes a support spine; a seat assembly coupled to the support spine, the seat assembly defining a sagittal plane bisecting the chair and dividing the chair into a left side and a right side, the seat assembly including: a flexible frame being movable relative to the support spine; a conformable panel coupled to the flexible frame and configured to engage an occupant of the chair; and a resistance assembly coupling the support spine to the flexible frame, the resistance assembly bearing against the flexible frame to facilitate rotation of the flexible frame and the conformable panel relative to the support spine about an axis disposed at an acute angle relative to the sagittal plane.

In a thirteenth example, the axis of the twelfth example is a first axis and the acute angle is a first acute angle, and the resistance assembly bears against the flexible frame to facilitate rotation of the flexible frame and the conformable panel relative to the support spine about a second axis disposed at a second acute angle relative to the sagittal plane.

In a fourteenth example, the resistance assembly of the twelfth example or the thirteenth example includes: a first connecting link pivotably coupled to the support spine and coupled the flexible frame, the first connecting link facilitating rotation of the flexible frame and the conformable panel relative to the support spine about the first axis; and a second connecting link pivotably coupled to the support spine and coupled the flexible frame, the second connecting link facilitating rotation of the flexible frame and the conformable panel relative to the support spine about the second axis.

In a fifteenth example, the resistance assembly of the fourteenth example further includes a first slider translatably coupled to the support spine and pivotably coupled to the first connecting link, the first slider and the first connecting link facilitating rotation of the flexible frame and the conformable panel relative to the support spine about the first axis; and a second slider translatably coupled to the support spine and pivotably coupled to the second connecting link, the second slider and the second connecting link facilitating rotation of the flexible frame and the conformable panel relative to the support spine about the second axis.

In a sixteenth example, the resistance assembly of the twelfth example or the thirteenth example includes a first leaf spring coupled to the support spine and the flexible frame, the first leaf spring facilitating rotation of the flexible frame and the conformable panel relative to the support spine about the first axis; and a second leaf spring coupled to the support spine and the flexible frame, the second leaf spring facilitating rotation of the flexible frame and the conformable panel relative to the support spine about the second axis.

In a seventeenth example, the resistance assembly of the sixteenth example further includes a stiffness adjustment component movable along the first leaf spring and the second leaf spring to facilitate adjustment of bending stiffnesses of the first leaf spring and the second leaf spring.

In an eighteenth example, the resistance assembly of the sixteenth example further includes a first connecting link coupled to the flexible frame and pivotably coupled to the first leaf spring, the first connecting link and the first leaf spring facilitating rotation of the flexible frame and the conformable panel relative to the support spine about the first axis; and a second connecting link coupled to the flexible frame and pivotably coupled to the second leaf spring, the second connecting link and the second leaf spring facilitating rotation of the flexible frame and the conformable panel relative to the support spine about the second axis.

In a nineteenth example, the resistance assembly of the twelfth example or the thirteenth example further includes a first flexible arm coupled to the support spine and the flexible frame, the first flexible arm having a dog legged shape, and the first flexible arm facilitating rotation of the flexible frame and the conformable panel relative to the support spine about the first axis; and a second flexible arm coupled to the support spine and the flexible frame, the second flexible arm having a dog legged shape, the second flexible arm facilitating rotation of the flexible frame and the conformable panel relative to the support spine about the second axis.

In a twentieth example, the resistance assembly and the flexible frame of the twelfth example or the thirteenth example facilitate rotation of the flexible frame and the conformable panel relative to the support spine about a third axis, the third axis being substantially perpendicular to the sagittal plane.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
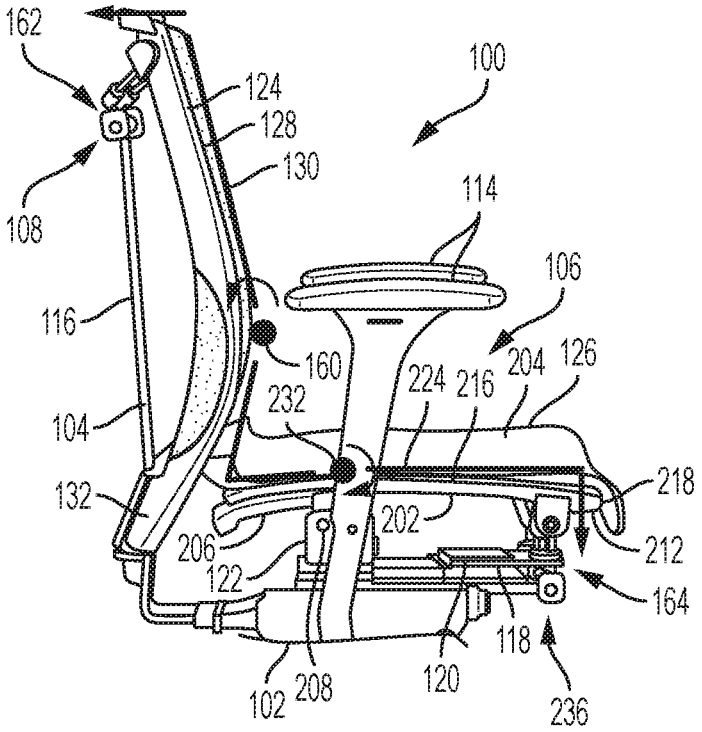
FIG. 1 is a partial side view of a chair, according to some embodiments of the present disclosure.

It should be understood that the drawings are intended facilitate understanding of exemplary embodiments of the present invention are not necessarily to scale.

DETAILED DESCRIPTION

The following description refers to the accompanying drawings which show specific embodiments. Although specific embodiments are shown and described, it is to be understood that additional or alternative features are employed in other embodiments. The following detailed description is not to be taken in a limiting sense, and the scope of the claimed invention is defined by the appended claims and their equivalents.

It should be understood that like reference numerals are intended to identify the same structural components, elements, portions, or surfaces consistently throughout the several drawing figures, as such components, elements, portions, or surfaces may be further described or explained by the entire written specification, of which this detailed description is an integral part. Unless otherwise indicated, the drawings are intended to be read (for example, cross-hatching, arrangement of parts, proportion, degree, etc.) together with the specification, and are to be considered a portion of the written description.

Generally, chairs according to some embodiments of the present disclosure include conformable back and/or seat surfaces (for example, formed by meshes, thin and flexible polymers, thermoplastics, and the like) that are supported by a flexible frame. The flexible frame is structured in a manner that facilitates both substantially independent and simultaneous movement of different portions thereof and the conformable back and/or seat surfaces (for example, the corners of the back and/or the seat) when an occupant applies certain forces to the flexible frame (for example, by sitting in certain postures, changing postures, or stretching). The flexible frame is coupled to a support spine via a resistance assembly. The resistance assembly urges the flexible frame to resist movement, and thereby stores energy, when the occupant applies certain forces to the flexible frame. As a result, the resistance assembly causes the flexible frame to bear against, and thereby support, the occupant in various postures and during various movements.

More specifically, chairs according to some embodiments of the present disclosure provide stable support for the occupant's pelvis in various seated postures and facilitate comfortable movement of the occupant's limbs and spine (for example, associated with changing seated postures, performing office tasks, stretching, and the like). This in turn facilitates occupant productivity. Chairs according to some embodiments of the present disclosure provide support for the occupant's pelvis in a seated anterior position and maintain healthy lumbar curvature, and permit lateral tilt of the occupant's pelvis to minimize lateral curvature of lower spine when leaning or reaching. Chairs according to some embodiments of the present disclosure provide support for the occupant's pelvis in various positions of the occupant's legs, including standard seating posture (that is, hips flexed and knees flexed to 90 degrees), legs out (that is, hips flexed, knees extended, and heels resting on the ground), legs crossed (that is, hips adducted and laterally rotated), and feet under the seat (that is, hips flexed and knees flexed greater than 90 degrees). Chairs according to some embodiments of the present disclosure facilitate comfortable task-related movements and stretching, including leaning to reach forward, leaning to reach laterally, leaning to reach laterally and rearward, and moving to a position with the hands behind head with the elbows out and back (that is, shoulders abducted with extension and lateral rotation).

FIGS. 1-16B illustrate a chair 100 according to some embodiments of the present disclosure. Generally, the chair 100 includes a base 102 that is configured to engage the ground. The base 102 carries a support spine 104, a seat assembly 106, and a resistance assembly 108 that couples the support spine 104 to the seat assembly 106. The resistance assembly 108 and the seat assembly 106 also facilitate both substantially independent and simultaneous rotation of portions of the seat assembly 106 relative to the support spine 104 to accommodate various occupant postures and movements, such as those described above. These components and aspects of the chair 100 are described in further detail below.

Referring specifically to FIGS. 1-4 and 7-9, the base 102 may include various materials that are appropriate for carrying the weight of an occupant, such as metals, polymers, or the like. The base 102 may be adjustable in a height direction relative to the ground to facilitate adjusting the position of the seat assembly 106, the resistance assembly 108, and the support spine 104 above the ground. The base 102 includes ground-engaging legs 110, and, as shown in the figures, the legs 110 may include casters 112 to facilitate movement of the chair 100 across the ground. In other embodiments, the legs 110 may lack casters 112. In some embodiments, the base 102 may facilitate rotation of some portions thereof, the support spine 104, the seat assembly 106, and the resistance assembly 108 relative to the legs 110 about a substantially vertical axis. In some embodiments and as shown in the figures, the base 102 further includes arm rests 114, which may be adjustable in the height direction relative to the ground. In other embodiments, the base 102 may lack arm rests 114.

Referring specifically to FIGS. 1-6, the support spine 104 generally includes a back portion 116 that is disposed rearwardly and below the seat assembly 106 and a seat portion 118 that is disposed below the seat assembly 106. As shown in the figures, the back portion 116 and the seat portion 118 could be separately formed and fixedly coupled to the base 102 (for example, via fasteners, welding, or the like). In other embodiments, the back portion 116 and the seat portion 118 are monolithically formed with each other and fixedly coupled to the base 102, or one or both of the back portion 116 and the seat portion 118 are monolithically formed with the base 102.

Figure 3:
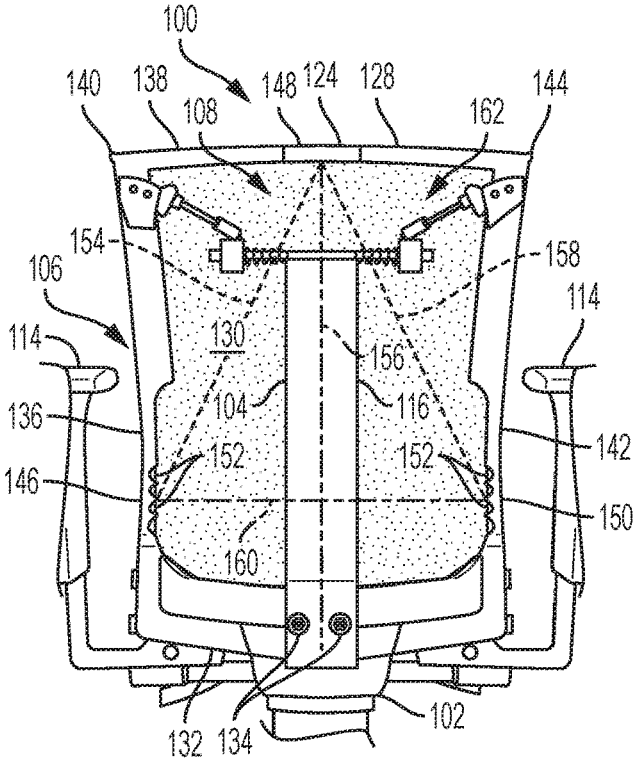
FIG. 3 is a partial rear view of the chair of FIG. 1.
Figure 4:
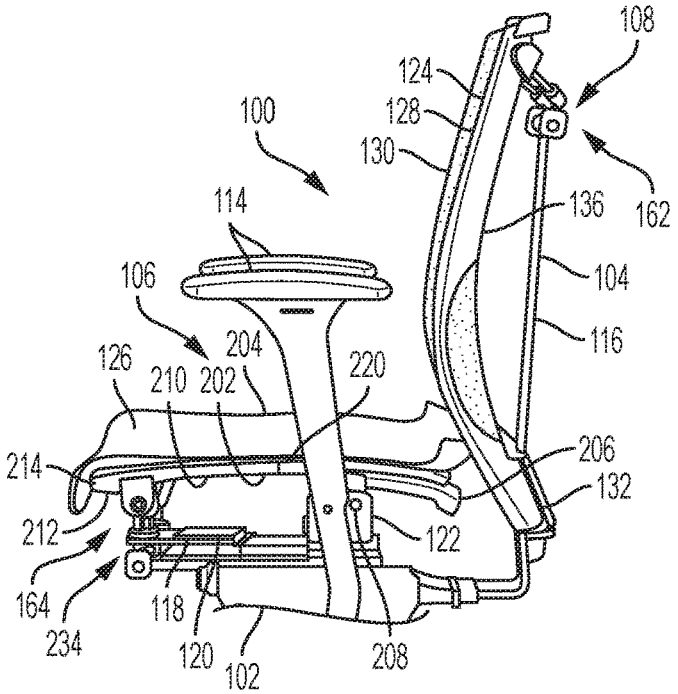
FIG. 4 is a partial opposite side view of the chair of FIG. 1.
Figure 5:
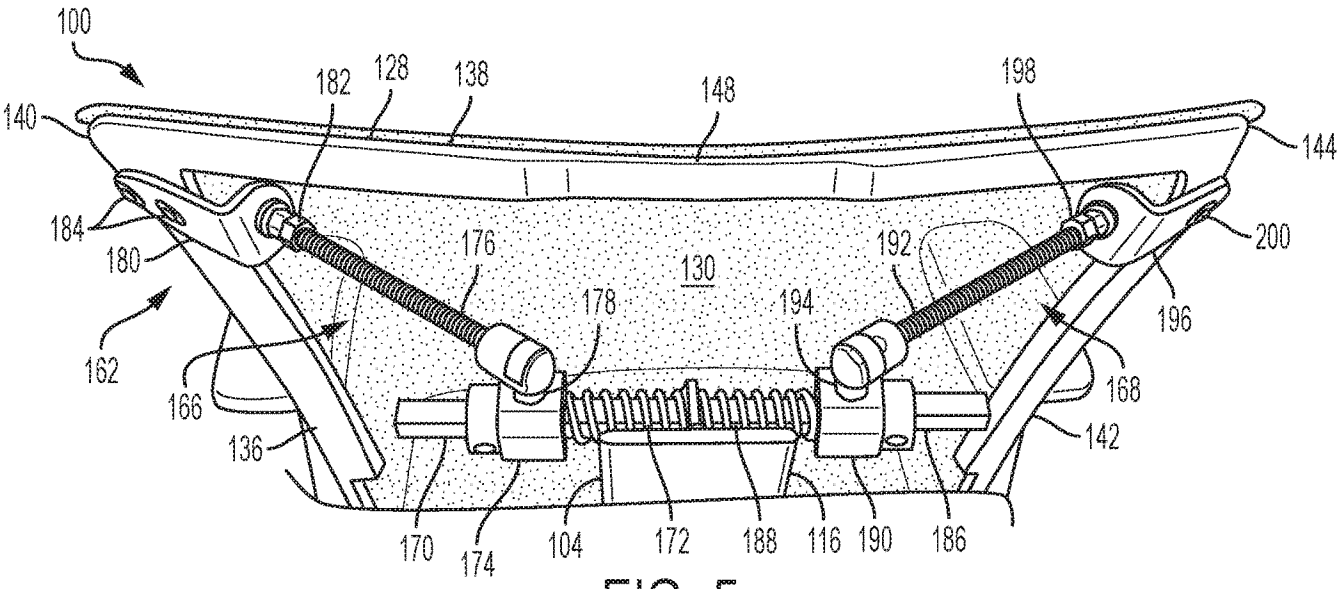
FIG. 5 is a partial top view of the chair of FIG. 1.
Figure 6:
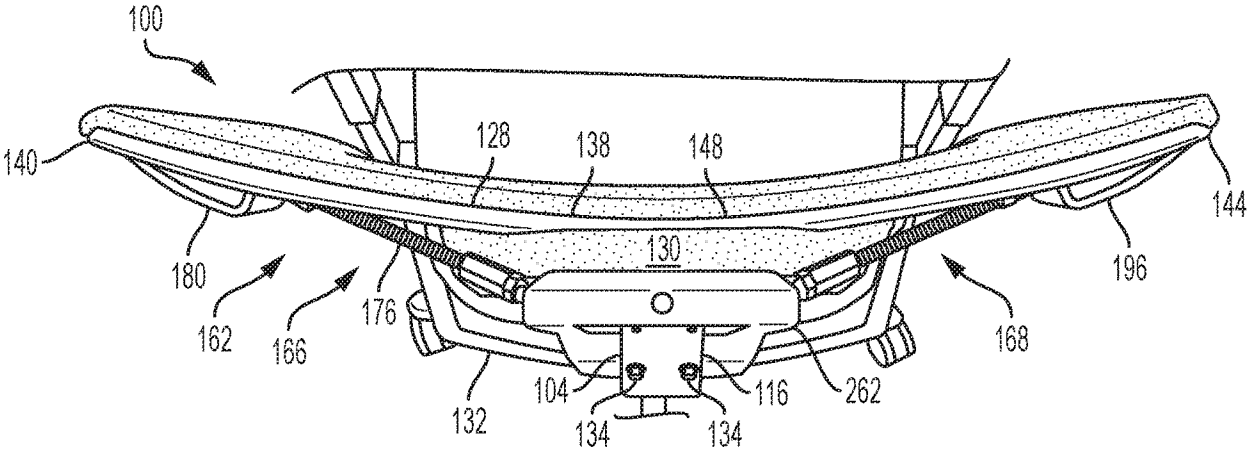
FIG. 6 is another partial top view of the chair of FIG. 1.

The back portion 116 of the support spine 104 may include various materials, such as metals, polymers, or the like. The back portion 116 of the support spine 104 may include various shapes. For example and as shown in FIGS. 1-4, the back portion 116 of the support spine 104 may have a dog legged shape as viewed from the sides (for example, as shown in FIGS. 1 and 4) and a rectangular cross-sectional shape. As another example and as shown in FIGS. 5 and 6, the back portion 116 of the support spine 104 may have a dog legged shape as viewed from the sides and a T-shaped cross-section.

Figure 12:
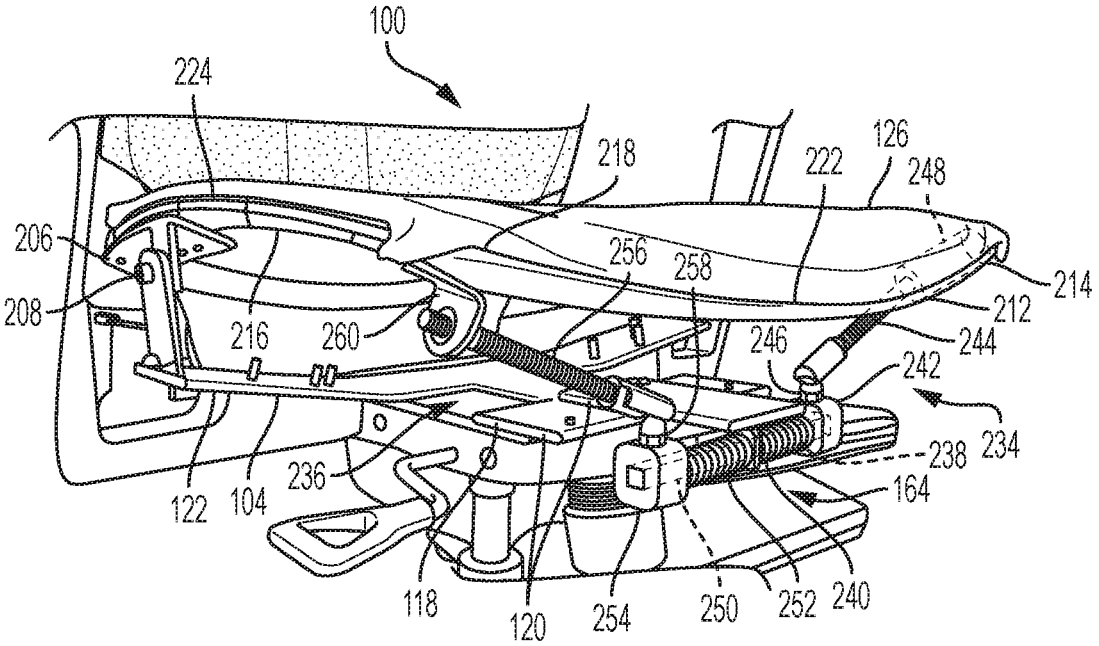
FIG. 12 is a partial lower front perspective view of the chair of FIG. 1.

The seat portion 118 of the support spine 104, like the back portion 116, may include various materials, such as metals, polymers, or the like. The seat portion 118 of the support spine 104 may include various shapes. For example and as shown in FIGS. 1, 4, and 12, the seat portion 118 of the support spine 104 may have a plurality of flat plates 120 near the front of the seat assembly 106 and a U-shaped bracket 122 (see FIG. 12) near the back of the seat assembly 106.

Referring again to FIGS. 1-6, the seat assembly 106 generally includes a back 124 that engages the back of the occupant and a seat 126 that engages the legs of the occupant. The back 124 includes a first flexible frame 128 that may include various materials, such as metals, polymers, or the like. The first flexible frame 128 defines the perimeter of the back 124 and carries a first conformable panel 130 (for example, formed by a mesh, a flexible polymer, or the like). The first conformable panel 130 obscures the interior of the first flexible frame 128 and provides a back surface for engaging the back of the occupant. The first flexible frame 128 includes several elements that define the perimeter thereof. Specifically, the first flexible frame 128 includes a static element 132 that is fixedly coupled to the support spine 104 (for example, via fasteners 134, as shown in the figures, welding, or the like). The static element 132 couples (for example, monolithically couples) to a left upright element 136, also referred to as a first frame element. The left upright element 136 couples (for example, monolithically couples) to an upper element 138, also referred to as a second frame element, at a first or left corner 140. The upper element 138 couples (for example, monolithically couples) to a right upright element 142, also referred to as a third frame element, at a second or right corner 144. The right upright element 142 couples (for example, monolithically couples) to the static element 132 opposite the left upright element 136.

The shapes of the upright elements, the upper element 138, and the corners 140 and 144 may vary from those shown in the figures. For example, one or more of the upright elements 136 and 142, the upper element 138, and the corners 140 and 144 may have more of a curved shape as viewed from the front and back of the chair 100 (see FIGS. 2 and 3) to provide the seat 126 with more of a curved appearance as viewed from the front and back of the chair 100. As another example, one or more of the upright elements 136 and 142, the upper element 138, and the corners 140 and 144 may have straight shapes as viewed from the front and back of the chair 100 to provide the seat 126 with a rectangular appearance as viewed from the front and back of the chair 100.

The upright elements 136 and 142 and the upper element 138 include several elements that facilitate flexibility of the first flexible frame 128. Specifically and as shown most clearly in FIG. 3, the left upright element 136 includes a first flexible section 146 (disposed, for example, near the static element 132), the upper element 138 includes a second flexible section 148 (disposed, for example, between the first corner 140 and the second corner 144), and the right upright element 142 includes a third flexible section 150 (disposed, for example, near the static element 132). The flexible sections 146, 148, and 150 have relatively low bending stiffnesses compared to the bending stiffnesses of adjacent sections of the first flexible frame 128. More specifically, these bending stiffnesses are with respect to transverse axes that are perpendicular to the longitudinal directions of the elements and lying in a general "plane" defined by the seat 126. The flexible sections 146, 148, and 150 could be between 20% and 80% as stiff as the adjacent sections of the first flexible frame 128. Or more particularly the flexible sections 146, 148, and 150 could be between 40% and 60% as stiff or more particularly 50% as stiff as the adjacent sections of the first flexible frame 128. The flexible sections 146, 148, and 150 may have relatively low bending stiffnesses compared to adjacent sections of the first flexible frame 128 by being formed by relatively flexible materials and/or having cross sections with relatively small areas. For example and as shown in FIGS. 5 and 6, the second flexible section 148 has the same cross-sectional shape as adjacent sections of the first flexible frame 128, but a smaller area. As another example and as shown in FIG. 3, the first and third flexible sections 146 and 150 include cavities 152 that provide the sections with smaller cross-sectional areas than adjacent sections of the first flexible frame 128.

Figure 2:
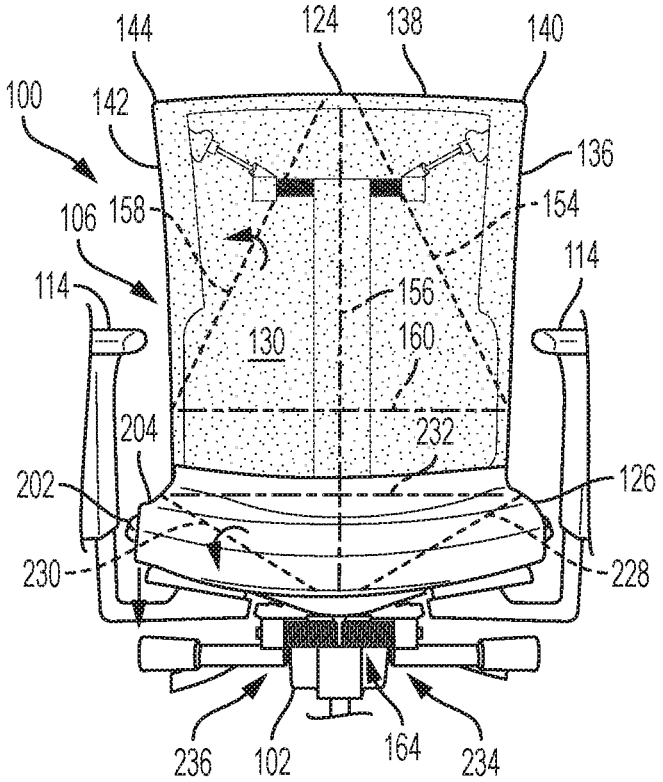
FIG. 2 is a partial front view of the chair of FIG. 1.

Referring specifically to FIGS. 1 and 2, the flexible sections 146, 148, and 150 together define axes of rotation for the first flexible frame 128 and the first conformable panel 130. More specifically, the first flexible section 146 and the second flexible section 148 together define, and are both intersected by, a first axis of rotation 154. The first axis of rotation 154 is disposed at a first acute angle relative to the sagittal plane 156 of the chair 100 (that is, a plane bisecting the chair 100 and dividing the chair 100 into a left side and a right side). As such, the first axis of rotation 154 is also referred to as a "diagonal" axis. Portions of the back 124 on a first side of the first axis 154 may substantially independently move relative to portions of the back 124 on a second side of the first axis 154. More specifically, the first corner 140 may rotate about the first axis 154 while the second corner 144 remains substantially stationary or moves in a forward direction relative to the support spine 104 to help maintain contact with a back of a user, for example (see, e.g., FIGS. 8 and 9) (as used herein, the terms "substantially independent movement," "substantially stationary", and variations thereof indicate that any incidental movement of a stationary component is less than 10 percent of the movement of a moving component). This may occur, for example, if the occupant applies a force at or near the first corner 140 and does not apply a force at or near the second corner 144.

The second flexible section 148 and the third flexible section 150 together define, and are both intersected by, a second axis of rotation 158. The second axis of rotation 158 is disposed at a second acute angle relative to the sagittal plane 156 of the chair 100. As such, the second axis of rotation 158 is also referred to as a "diagonal" axis. Portions of the back 124 on a first side of the second axis 158 may substantially independently move relative to portions of the back 124 on a second side of the second axis 158. More specifically, the second corner 144 may rotate backward about the second axis 158 while the first corner 140 remains substantially stationary or moves in a forward direction relative to the support spine 104 to help maintain contact with a back of a user, for example (see, e.g., FIGS. 8 and 9). This may occur, for example, if the occupant applies a force at or near the second corner 144 and does not apply a force at or near the first corner 140.

The first flexible section 146 and the third flexible section 150 together define, and are both intersected by, a third axis of rotation 160. The third axis of rotation 160 is substantially perpendicular to the sagittal plane 156 of the chair 100 (that is, perpendicular within 10 degrees). As such, the third axis of rotation 160 is also referred to as a "horizontal" axis. Portions of the back 124 on a first side of the third axis 160 may substantially independently move relative to portions of the back 124 on a second side of the third axis 160. More specifically, the first corner 140 and the second corner 144 may rotate about the third axis 160 while portions of the back 124 near the seat 126 remain substantially stationary relative to the support spine 104. This may occur, for example, if the occupant applies forces at or near the first corner 140 and the second corner 144, or if the occupant applies a force at or near the second flexible section 148.

In some situations, portions of the back 124 may simultaneously rotate about the first axis 154, the second axis 158, and/or the third axis 160 relative to other portions of the back 124 depending on the locations and magnitudes of forces applied to the back 124.

Referring again to FIGS. 1-6 and as described briefly above, the resistance assembly 108 urges the flexible frame 128 to resist movement, and thereby stores energy, when the occupant applies certain forces to the flexible frame 128. As a result, the resistance assembly 108 causes the flexible frame 128 to bear against, and thereby support, the occupant in various postures and during various movements.

The resistance assembly 108 generally includes an upper portion 162 that couples the back 124 to the back portion 116 of the support spine 104 and a lower portion 164 that couples the seat 126 to the seat portion 118 of the support spine 104. Referring specifically to FIGS. 5 and 6, the upper portion 162 of the resistance assembly 108 generally includes a left portion 166 that couples the support spine 104 to the back 124 at or near the first corner 140 and a right portion 168 that couples the support spine 104 to the back 124 at or near the second corner 144. In some embodiments, the left portion 166 applies forces to the back 124 in a direction that is substantially perpendicular to the first axis 154 (that is, perpendicular within 10 degrees), and the right portion 168 applies forces to the back 124 in a direction that is substantially perpendicular to the second axis 158 (that is, perpendicular within 10 degrees). In some embodiments, the left portion 166 and the right portion 168 are configured to apply forces to the back 124 independently of each other.

The left portion 166 and the right portion 168 of the upper portion 162 of the resistance assembly 108 may have various structures. Referring first to the left portion 166, in some embodiments and as shown in the figures, a rod 170 is fixedly coupled to the back portion 116 of the support spine 104 (for example, via welding, fasteners, or the like). The rod 170 may extend substantially perpendicularly relative to the sagittal plane 156 (that is, perpendicularly within 10 degrees). The rod 170 carries a compression spring 172, and the compression spring 172 is compressible between the support spine 104 and a first slider 174 that is translatably carried by the rod 170. The slider 174 pivotably couples to a first connecting link 176 (for example, via a three-degree-of-freedom joint, such as a ball and socket joint 178). The connecting link 176 may extend substantially perpendicularly relative to the first axis 154 (that is, perpendicularly within 10 degrees). The connecting link 176 fixedly couples to a bracket 180 (for example, via a fastener 182, welding, or the like), and the bracket 180 fixedly couples to the flexible frame 128 at or near the first corner 140 (for example, via one or more fasteners 184, welding, or the like). These components may include various materials, such as metals, polymers, or the like.

In some embodiments and as shown in the figures, the right portion 168 of the upper portion 162 of the resistance assembly 108 is a mirror image of the left portion 166 (over the sagittal plane 156). That is, the right portion 168 includes a rod 186 that is fixedly coupled to the back portion 116 of the support spine 104 (for example, via welding, fasteners, or the like). The rod 186 may extend substantially perpendicularly relative to the sagittal plane 156 (that is, perpendicularly within 10 degrees). The rod 186 carries a compression spring 188, and the compression spring 188 is compressible between the support spine 104 and a second slider 190 that is translatably carried by the rod 186. The slider 190 pivotably couples to a second connecting link 192 (for example, via a three-degree-of-freedom joint, such as a ball and socket joint 194). The connecting link 192 may extend substantially perpendicularly relative to the second axis 158 (that is, perpendicularly within 10 degrees). The connecting link 192 fixedly couples to a bracket 196 (for example, via a fastener 198, welding, or the like), and the bracket 196 fixedly couples to the flexible frame at or near the second corner 144 (for example, via one or more fasteners 200, welding, or the like). These components may include various materials, such as metals, polymers, or the like.

The resistance provided by the left portion 166 and the right portion 168 against the back 124 is a function of, and can be modified by varying one or more of the following parameters: (1) the spring constant of the compression springs 172 and 188; (2) the preload, if any, carried by the compression springs 172 and 188; (3) the angle of the rods 170 and 186 relative to the sagittal plane 156; (4) the position of the three-degree-of-freedom joints 178 and 194 on the sliders 174 and 190; (5) the angle of the connecting links 176 and 192 relative to the rods 170 and 186; and (6) the dimensions of the components.

Figure 7:
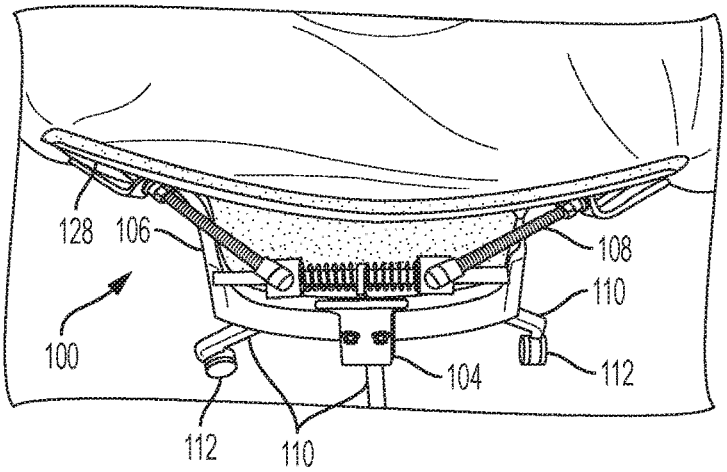
FIG. 7 is a partial top view of the chair of FIG. 1 with an occupant seated in an upright posture.
Figure 8:
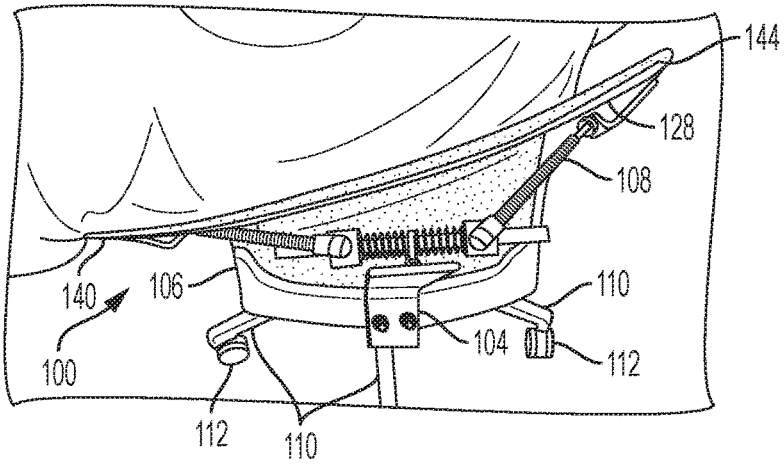
FIG. 8 is a partial top view of the chair of FIG. 1 with the occupant leaning laterally to the left.
Figure 9:
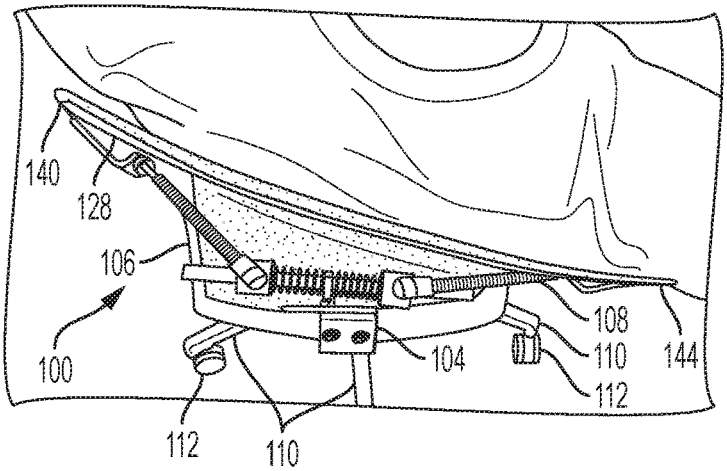
FIG. 9 is a partial top view of the chair of FIG. 1 with the occupant leaning laterally to the right.
Figure 10:
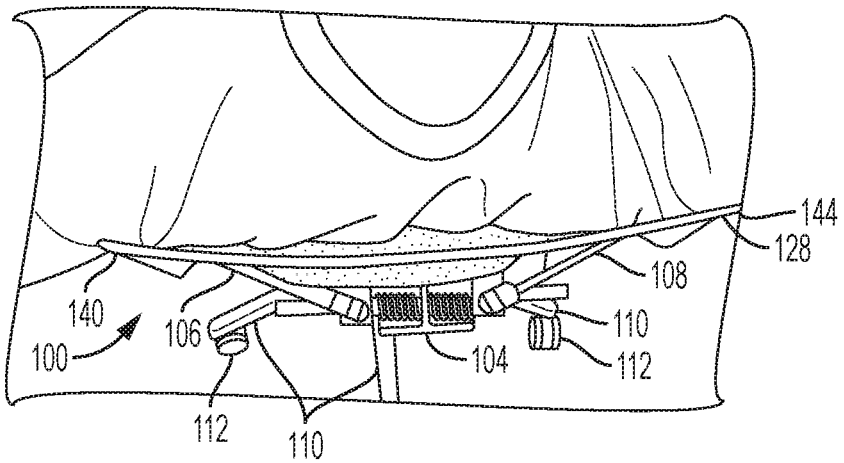
FIG. 10 is a partial top view of the chair of FIG. 1 with the occupant seated in a reclined posture.
Figure 11:
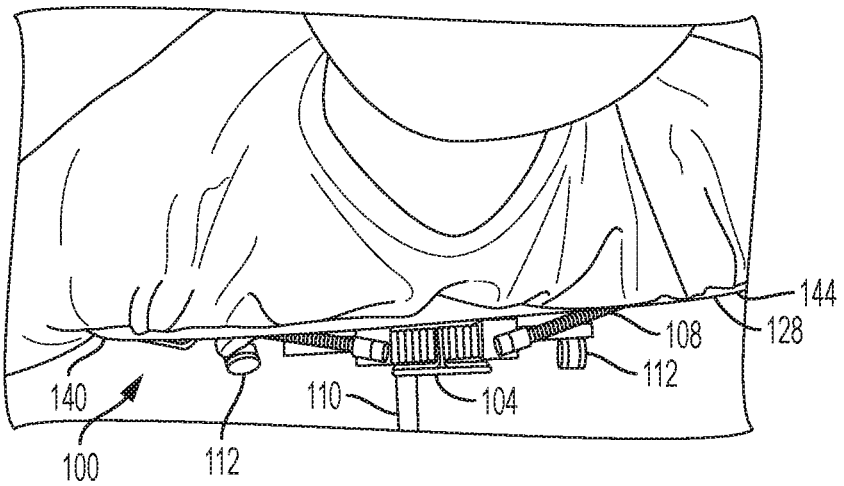
FIG. 11 is a partial top view of the chair of FIG. 1 with the occupant seated in a posture with the shoulders abducted.

FIGS. 7-11 illustrate examples of how the first flexible frame 128 facilitates both substantially independent and simultaneous movement of different portions thereof and how the upper portion 162 of the resistance assembly 108 causes the first flexible frame 128 to bear against the occupant in various postures and during various movements. More specifically, FIG. 7 illustrates the occupant seated in an upright posture (that is, without applying forces to the back 124). FIG. 8 illustrates the occupant leaning laterally to the left and applying a force to the first corner 140 of the back 124 with the left shoulder. As a result, the first corner 140 has moved while the second corner 144 moved in a forward direction relative to the support spine 104 to help maintain contact with a back of a user, for example. FIG. 9 illustrates the occupant leaning laterally to the right and applying a force to the second corner 144 of the back 124 with the right shoulder. As a result, the second corner 144 has moved while the first corner 140 has moved in a forward direction relative to the support spine 104 to help maintain contact with a back of a user, for example. FIG. 10 illustrates the occupant seated in a reclined posture and applying forces to both the first corner 140 and the second corner 144 of the back 124. As a result, both the first corner 140 and the second corner 144 have moved relative to the support spine 104. FIG. 11 illustrates the occupant seated in a posture with the shoulders abducted and applying forces to both the first corner 140 and the second corner 144 of the back 124. As a result, both the first corner 140 and the second corner 144 have moved relative to the support spine 104.

Referring again to FIGS. 1-4 and also FIG. 12, the seat 126 of the seat assembly 106 includes a second flexible frame 202 that may include various materials, such as metals, polymers, or the like. The second flexible frame 202 defines the perimeter of the seat 126 and carries a second conformable panel 204 (for example, formed by a mesh, a flexible polymer, or the like). The second conformable panel 204 obscures the interior of the second flexible frame 202 and provides a seat surface for engaging the legs of the occupant. The second flexible frame 202 includes several elements that define the perimeter thereof. Specifically, the second flexible frame 202 includes a static element 206 that is either pivotally (e.g., via a one-degree-of-freedom joint) or fixedly coupled to the U-shaped bracket 122 of the support spine 104 (for example, via fasteners 208, as shown in the figures, welding, or the like). In some examples, the one-degree-of-freedom joint is pinned joint. In other examples, the one-degree-of-freedom joint is formed by a flexible coupling (e.g., a resilient polymeric joint designed to flex under sufficient torsional load). Examples of such resilient polymeric or metallic joints include a U-shaped piece of material configured to close and open in response to loading, or what would more commonly be referred to as a U-shaped leaf spring.

The static element 206 couples (for example, monolithically couples) to a left side element 210 (see FIG. 4), also referred to as a first frame element. The left side element 210 couples (for example, monolithically couples) to a front element 212, also referred to as a second frame element, at a first or left corner 214. The front element 212 couples (for example, monolithically couples) to a right side element 216

(see FIG. 1), also referred to as a third frame element, at a second or right corner 218. The right side element 216 couples (for example, monolithically couples) to the static element 206 opposite the left side element 210.

The shapes of the side elements 210 and 216, the front element 212, and the corners 214 and 218 may vary from those shown in the figures. For example, one or more of the side elements 210 and 216, the front element 212, and the corners 214 and 218 may have more of a curved shape as viewed from the top of the chair 100 to provide the seat 126 with more of a curved appearance as viewed from the top of the chair 100. As another example, one or more of the side elements 210 and 216, the front element 212, and the corners 214 and 218 may have straight shapes as viewed from the top of the chair 100 to provide the seat 126 with a rectangular appearance as viewed from the top of the chair 100.

Referring specifically to FIGS. 1, 4 and 12, the side elements 210 and 216 and the front element 212 include several elements that facilitate flexibility of the second flexible frame 202. Specifically, the left side element 210 includes a first flexible section 220 (disposed, for example, near the static element 206), the front element 212 includes a second flexible section 222 (disposed, for example, between the first corner 214 and the second corner 218), and the right side element 216 includes a third flexible section 224 (disposed, for example, near the static element 206). The flexible sections 220, 222, and 224 have relatively low bending stiffnesses compared to the bending stiffnesses of adjacent sections of the second flexible frame 202. More specifically, these bending stiffnesses are with respect to transverse axes that are perpendicular to the longitudinal directions of the elements and lying in a general "plane" defined by the seat 126. The flexible sections 220, 222, and 224 could be between 20% and 80% as stiff as the adjacent sections of the second flexible frame 202. Or more particularly the flexible sections 220, 222, and 224 could be between 40% and 60% as stiff or more particularly 50% as stiff as the adjacent sections of the second flexible frame 202. The flexible sections 220, 222, and 224 may have relatively low bending stiffnesses compared to adjacent sections of the second flexible frame 202 by being formed by relatively flexible materials and/or having cross sections with relatively small areas.

Referring specifically to FIG. 2, the flexible sections 220, 222, and 224 together define axes of rotation for the second flexible frame 202 and the second conformable panel 204. More specifically, the first flexible section 220 and the second flexible section 222 together define, and are both intersected by, a first axis of rotation 228. The first axis of rotation 228 is disposed at a first acute angle relative to the sagittal plane 156 of the chair 100. As such, the first axis of rotation 228 is also referred to as a "diagonal" axis. Portions of the seat 126 on a first side of the first axis 228 may substantially independently move relative to portions of the seat 126 on a second side of the first axis 228. More specifically, the first corner 214 may rotate about the first axis 228 while the second corner 218 remains substantially stationary or moves in an upward direction relative to help maintain contact with a bottom of a user, for example. This may occur, for example, if the occupant applies a force at or near the first corner 214 and does not apply a force at or near the second corner 218.

The second flexible section 222 and the third flexible section 224 together define, and are both intersected by, a second axis of rotation 230. The second axis of rotation 230 is disposed at a second acute angle relative to the sagittal plane 156 of the chair 100. As such, the second axis of rotation 230 is also referred to as a "diagonal" axis. Portions of the seat 126 on a first side of the second axis 230 may substantially independently move relative to portions of the seat 126 on a second side of the second axis 230. More specifically, the second corner 218 may rotate about the second axis 230 while the first corner 214 remains substantially stationary or moves in an upward direction to help maintain contact with a bottom of a user, for example. This may occur, for example, if the occupant applies a force at or near the second corner 218 and does not apply a force at or near the first corner 214.

The first flexible section 220 and the third flexible section 224 together define, and are both intersected by, a third axis of rotation 232. The third axis of rotation 232 is substantially perpendicular to the sagittal plane 156 of the chair 100 (that is, perpendicular within 10 degrees). As such, the third axis of rotation 232 is also referred to as a "horizontal" axis. Portions of the seat 126 on a first side of the third axis 232 may substantially independently move relative to portions of the seat 126 on a second side of the third axis 232. More specifically, the first corner 214 and the second corner 218 may rotate about the third axis 232 while portions of the seat 126 near the back 124 remain substantially stationary relative to the support spine 104. This may occur, for example, if the occupant applies forces at or near the first corner 214 and the second corner 218, or if the occupant applies a force at or near the second flexible section 222.

In some situations, portions of the seat 126 may simultaneously rotate about the first axis 228, the second axis 230, and/or the third axis 232 relative to other portions of the seat 126 depending on the locations and magnitudes of forces applied to the seat 126.

Referring now to FIGS. 1-4 and 12, the lower portion 164 of the resistance assembly 108 couples the seat 126 to the seat portion 118 of the support spine 104. The lower portion 164 generally includes a left portion 234 that couples the support spine 104 to the seat 126 at or near the first corner 214 and a right portion 236 that couples the support spine 104 to the seat 126 at or near the second corner 218. In some embodiments, the left portion 234 applies forces to the seat 126 in a direction that is substantially perpendicular to the first axis 228 (that is, perpendicular within 10 degrees), and the right portion 236 applies forces to the seat 126 in a direction that is substantially perpendicular to the second axis 230 (that is, perpendicular within 10 degrees). In some embodiments, the left portion 234 and the right portion 236 are configured to apply forces to the seat 126 independently of each other.

The left portion 234 and the right portion 236 of the lower portion 164 of the resistance assembly 108 may have various structures, and one or both may be similar to the left portion 166 and the right portion 168 of the upper portion 162 of the resistance assembly 108, respectively. Referring specifically to FIG. 12 and first to the left portion 234, in some embodiments, a rod 238 is fixedly coupled to the seat portion 118 of the support spine 104 (for example, via welding, fasteners, or the like). The rod 238 may extend substantially perpendicularly relative to the sagittal plane 156 (that is, perpendicularly within 10 degrees). The rod 238 carries a compression spring 240, and the compression spring 240 is compressible between the support spine 104 and a first slider 242 that is translatably carried by the rod 238. The slider 242 pivotably couples to a first connecting link 244 (for example, via a three-degree-of-freedom joint, such as a ball and socket joint 246). The connecting link 244 may extend substantially perpendicularly relative to the first axis 228 (that is, perpendicularly within 10 degrees). The connecting link 244 fixedly couples to a bracket 248 (for example, via a fastener, welding, or the like), and the bracket 248 fixedly couples to the flexible frame at or near the first corner 214 (for example, via one or more fasteners, welding, or the like). These components may include various materials, such as metals, polymers, or the like.

In some embodiments and as shown in the figures, the right portion 236 of the lower portion 164 of the resistance assembly 108 is a mirror image of the left portion 234 (over the sagittal plane 156). That is, the right portion 236 includes a rod 250 that is fixedly coupled to the seat portion 118 of the support spine 104 (for example, via welding, fasteners, or the like). The rod 250 may extend substantially perpendicularly relative to the sagittal plane 156 (that is, perpendicularly within 10 degrees). The rod 250 carries a compression spring 252, and the compression spring 252 is compressible between the support spine 104 and a first slider 254 that is translatably carried by the rod 250. The slider 254 pivotably couples to a second connecting link 256 (for example, via a three-degree-of-freedom joint, such as a ball and socket joint 258). The connecting link 256 may extend substantially perpendicularly relative to the second axis 230 (that is, perpendicularly within 10 degrees). The connecting link 256 fixedly couples to a bracket 260 (for example, via a fastener, welding, or the like), and the bracket 260 fixedly couples to the flexible frame at or near the second corner 218 (for example, via one or more fasteners, welding, or the like). These components may include various materials, such as metals, polymers, or the like.

The resistance provided by the left portion 234 and the right portion 236 against the seat 126 is a function of, and can be modified by varying one or more of, the following parameters: (1) the spring constant of the compression springs 240 and 252; (2) the preload, if any, carried by the compression springs 240 and 252; (3) the angle of the rods 238 and 250 relative to the sagittal plane 156; (4) the position of the three-degree-of-freedom joints 246 and 258 on the sliders 242 and 254; (5) the vertical position of the a three-degree-of-freedom joint 246 and 258 (e.g., relative to the slider 254 or the bracket 260 and its counterpart) (5) the angle of the connecting links 244 and 256 relative to the rods 238 and 250; and (6) the dimensions of the components.

Figure 13A:
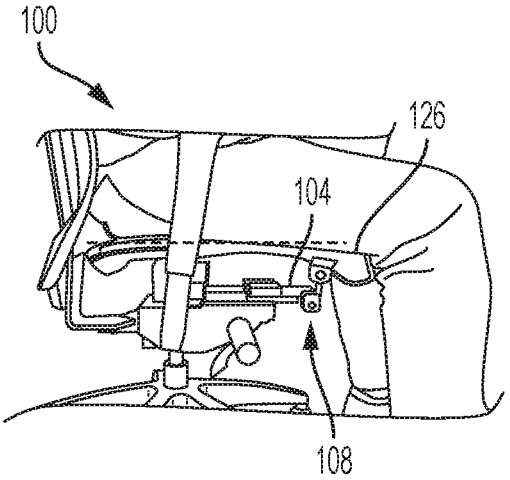
FIG. 13A is a partial side view of the chair of FIG. 1 with the occupant seated in a standard seating posture (that is, hips flexed and knees flexed to 90 degrees)
Figure 13B:
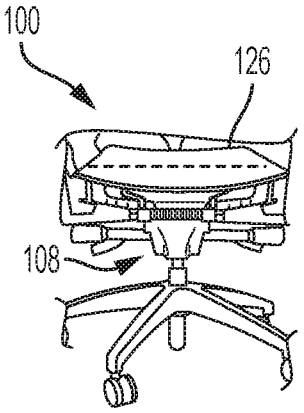
FIG. 13B is a partial front view of the chair of FIG. 1 with the occupant seated in a standard seating posture (that is, hips flexed and knees flexed to 90 degrees)
Figure 14A:
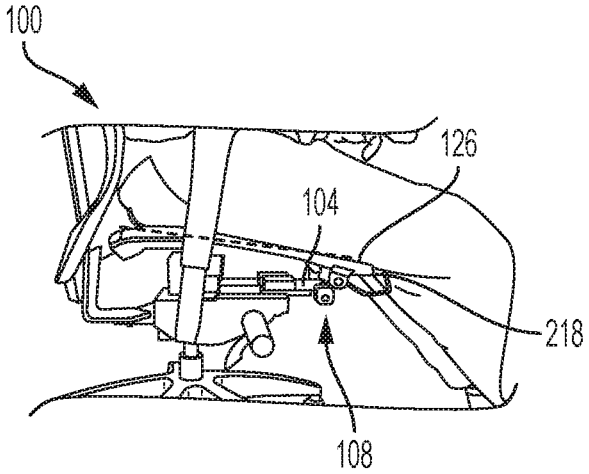
FIG. 14A is a partial side view of the chair of FIG. 1 with the occupant seated in a posture with both legs lowered relative to the standard seating position.
Figure 14B:
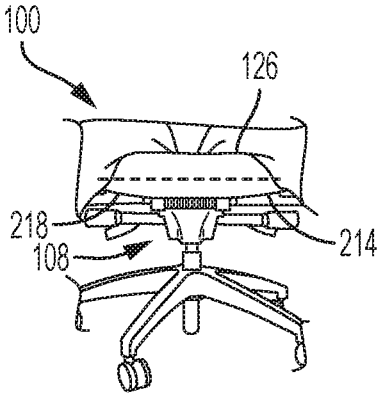
FIG. 14B is a partial front view of the chair of FIG. 1 with the occupant seated in a posture with both legs lowered relative to the standard seating position.
Figure 15A:
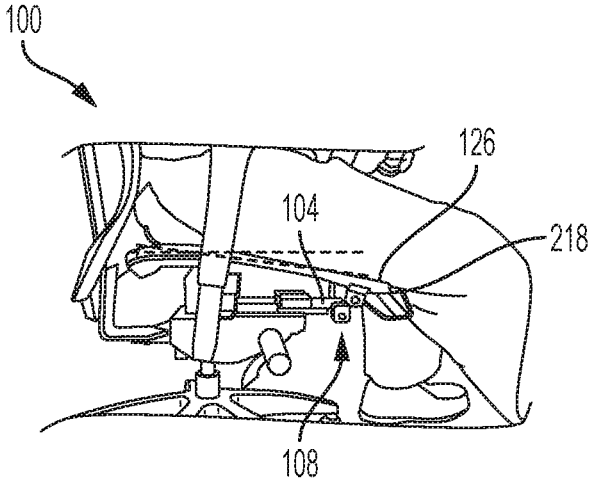
FIG. 15A is a partial side view of the chair of FIG. 1 with the occupant seated in a posture with the right leg lowered relative to the standard seating position.
Figure 15B:
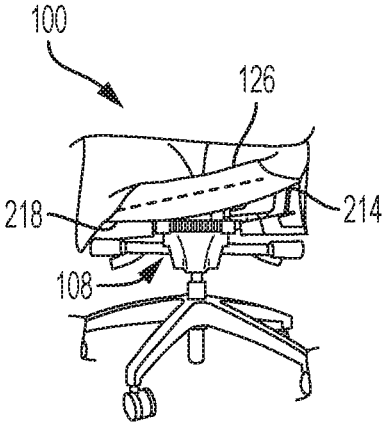
FIG. 15B is a partial front view of the chair of FIG. 1 with the occupant seated in a posture with the right leg lowered relative to the standard seating position.
Figure 16A:
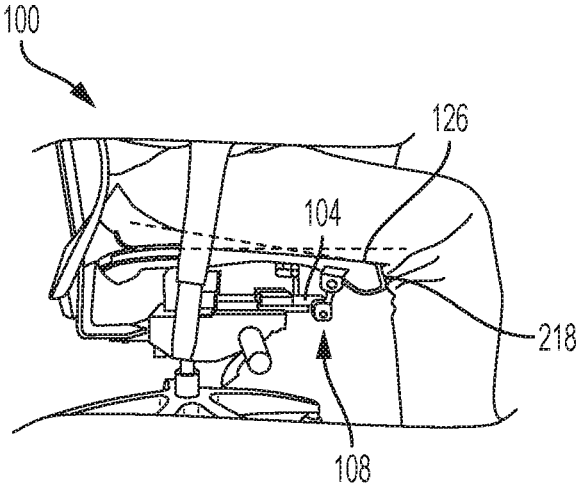
FIG. 16A is a partial side view of the chair of FIG. 1 with the occupant seated in a posture with the left leg lowered relative to the standard seating position.
Figure 16B:
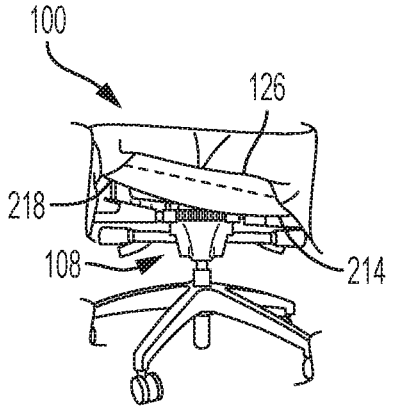
FIG. 16B is a partial front view of the chair of FIG. 1 with the occupant seated in a posture with the left leg lowered relative to the standard seating position.
Figure 17:
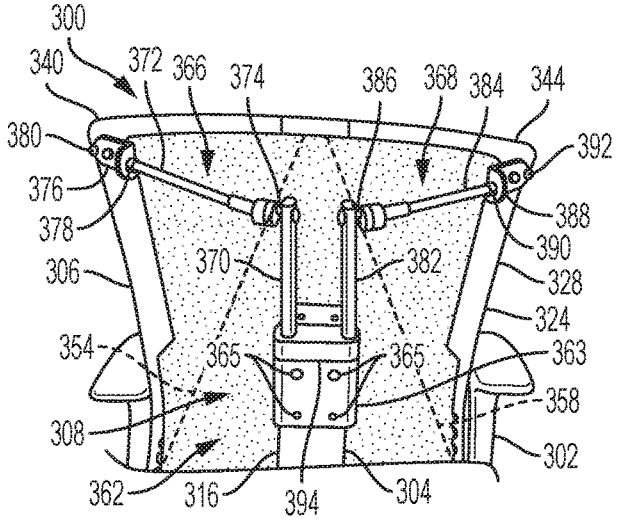
FIG. 17 is a partial rear view of another chair, according to some embodiments of the present disclosure.
Figure 18:
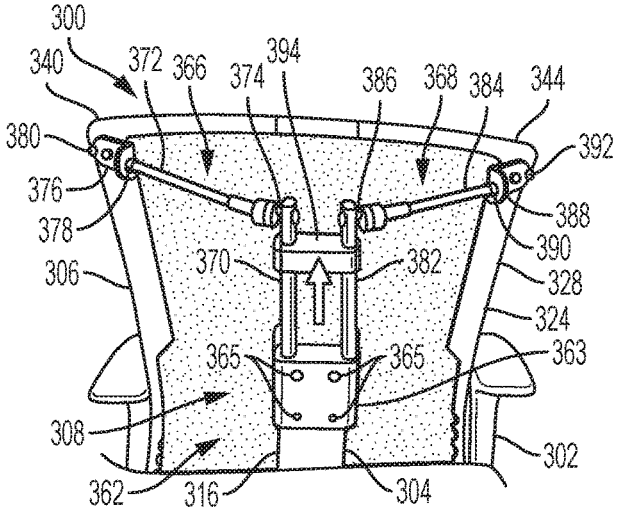
FIG. 18 is another partial rear view of the chair of FIG. 17.

FIGS. 13A-16B illustrate examples of how the second flexible frame 202 facilitates both substantially independent and simultaneous movement of different portions thereof and how the lower portion 164 of the resistance assembly 108 causes the second flexible frame 202 to bear against the occupant in various postures and during various movements. More specifically, FIGS. 13A and 13B illustrate the occupant seated in a standard seating posture (that is, hips flexed and knees flexed to 90 degrees) and without applying to the seat 126. FIGS. 14A and 14B illustrate the occupant seated in a posture with both legs lowered relative to the standard seating position and applying forces to both the first corner 214 and the second corner 218 of the seat 126. As a result, both the first corner 214 and the second corner 218 have moved relative to the support spine 104. FIGS. 15A and 15B illustrates the occupant seated in a posture with the right leg lowered relative to the standard seating position. As shown, the second corner 218 has moved while the first corner 214 has remained substantially stationary relative to the support spine 104. FIGS. 16A and 16B illustrates the occupant seated in a posture with the left leg lowered relative to the standard seating position. As shown, the first corner 214 has moved while the second corner 218 has remained substantially stationary relative to the support spine 104, although the second corner 218 may move upwardly if the user's hips rotate sufficiently, for example, to help maintain contact with the bottom of the user.

In some embodiments, the chair 100 includes a cover that obscures one or more components of the resistance assembly 108. As a specific example and as shown in FIG. 6, the chair 100 may include a cover 262 that obscures the rods 170 and 186, the compression springs 172 and 188, and the sliders 174 and 190.

FIGS. 17-21 illustrate another chair 300 according to some embodiments of the present disclosure. Generally, the chair 300 includes a base 302 and a seat assembly 306, which may be the same as or similar to the base 102 and the seat assembly 106 described above, respectively. The chair 300 also includes a support spine 304, which may be the same as or similar to the support spine 104 described above, except that a back portion 316 of the support spine 304 may be relatively short compared to the back portion 116 described above. Additionally, the chair 300 includes a resistance assembly 308 that causes the flexible frame 328 to bear against, and thereby support, the occupant in various postures and during various movements as described above. The resistance assembly 308 includes several different components than the resistance assembly 108 described above.

Still referring to FIGS. 17-21, an upper portion 362 of the resistance assembly 308 generally includes a mounting 363 that fixedly couples to the support spine 304 (for example, via fasteners 365 or the like). The mounting 363 couples to a left portion 366 that couples the support spine 304 to the seat assembly 306 at or near the first corner 340 and a right portion 368 that couples the support spine 304 to the seat assembly 306 at or near the second corner 344. In some embodiments, the left portion 366 and the right portion 368 are configured to apply forces to the back 324 independently of each other.

Referring first to the left portion 366, a first leaf spring 370 is fixedly coupled to the mounting 363. The leaf spring 370 flexes toward the second corner 344 when a force is applied to the first corner 340 (see, for example, FIG. 20). In some embodiments and as shown in the figures, the leaf spring 370 extends in a generally vertical direction, or in a direction parallel to the general plane of the back 324. In some embodiments and as shown in the figures, the leaf spring 370 may have a generally uniform cross-sectional shape (for example, an oval shape). In some embodiments, the leaf spring 370 has a bending stiffness of 50% or less than a bending stiffness of the flexible frame 328. Such a bending stiffness of the leaf spring 370 is with respect to a transverse axis that is perpendicular to the longitudinal direction of the leaf spring 370 and lying in the general plane defined by the back 324. As described in further detail below, the bending stiffness of the leaf spring 370 may be adjustable. The leaf spring 370 pivotably couples to a first connecting link 372 (for example, via a three-degree-of-freedom joint, such as a ball and socket joint 374). The connecting link 372 may extend substantially perpendicularly relative to the first axis 354 of the back 324 (see FIG. 17; that is, perpendicularly within 10 degrees). The connecting link 372 fixedly couples to a bracket 376 (for example, via a fastener 378, welding, or the like), and the bracket 376 fixedly couples to the flexible frame 328 at or near the first corner 340 (for example, via one or more fasteners 380, welding, or the like). These components may include various materials, such as metals, polymers, or the like.

In some embodiments and as shown in the figures, the right portion 368 of the upper portion 362 of the resistance assembly 308 is a mirror image of the left portion 366. That is, the right portion 368 includes a second leaf spring 382 that is fixedly coupled to the mounting 363. The leaf spring 382 flexes toward the first corner 340 when a force is applied to the second corner 344 (see, for example, FIG. 19). In some embodiments and as shown in the figures, the leaf spring 382 extends in a generally vertical direction, or in a direction parallel to the general plane of the back 324. In some embodiments and as shown in the figures, the leaf spring 382 may have a generally uniform cross-sectional shape (for example, an oval shape). In some embodiments, the leaf spring 382 has a bending stiffness of 50% or less than a bending stiffness of the flexible frame 328. Such a bending stiffness of the leaf spring 382 is with respect to a transverse axis that is perpendicular to the longitudinal direction of the leaf spring 382 and lying in the general plane defined by the back 324. As described in further detail below, the bending stiffness of the leaf spring 382 may be adjustable. The leaf spring 382 pivotably couples to a second connecting link 384 (for example, via a three-degree-of-freedom joint, such as a ball and socket joint 386). The connecting link 384 may extend substantially perpendicularly relative to the second axis 358 of the back 324 (that is, perpendicularly within 10 degrees). The connecting link 384 fixedly couples to a bracket 388 (for example, via a fastener 390, welding, or the like), and the bracket 388 fixedly couples to the flexible frame 328 at or near the second corner 344 (for example, via one or more fasteners 392, welding, or the like). These components may include various materials, such as metals, steel, polymers, glass-filled polymers, or the like.

As described above, the leaf springs 370 and 382 may have adjustable bending stiffnesses. To facilitate such adjustment, the leaf springs 370 and 382 may together carry a stiffness adjustment component 394 that is translatable along the leaf springs 370 and 382 in a generally vertical direction. Translation of the adjustment component 394 along the leaf springs 370 and 382 varies the length of the leaf springs 370 and 382 that flexes in response to forces applied to the back 324, which in turn varies the bending stiffnesses of the leaf springs 370 and 382. The adjustment component 394 may include various materials, such as metals, polymers, or the like.

In some embodiments and as shown in the figures, the leaf springs 370 and 382 may together carry a compression spring 396 that provides additional resistance to forces applied to the back 324.

Figure 19:
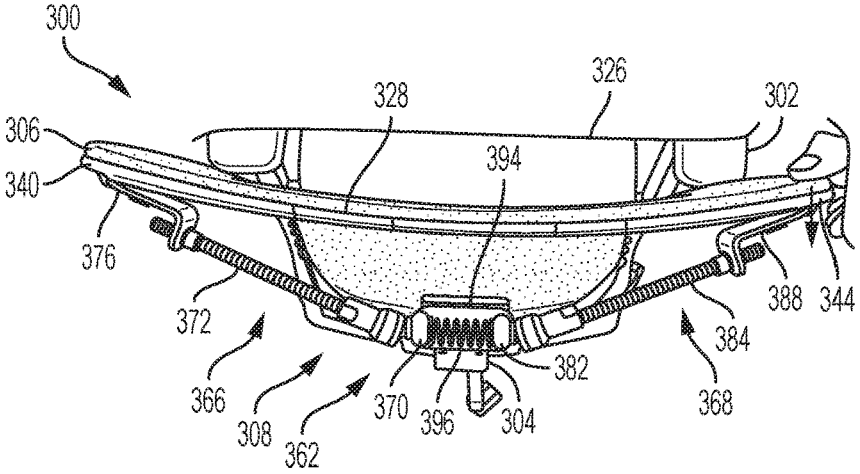
FIG. 19 is a partial top view of the chair of FIG. 17 with a force being applied to a right corner of the back of the chair.
Figure 20:
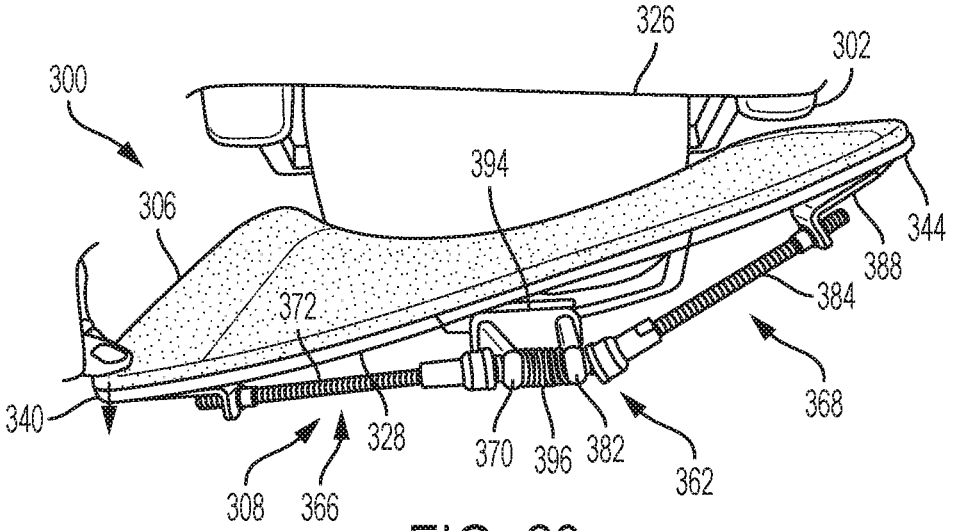
FIG. 20 is a partial top view of the chair of FIG. 17 with a force being applied to a left corner of the back of the chair.
Figure 21:
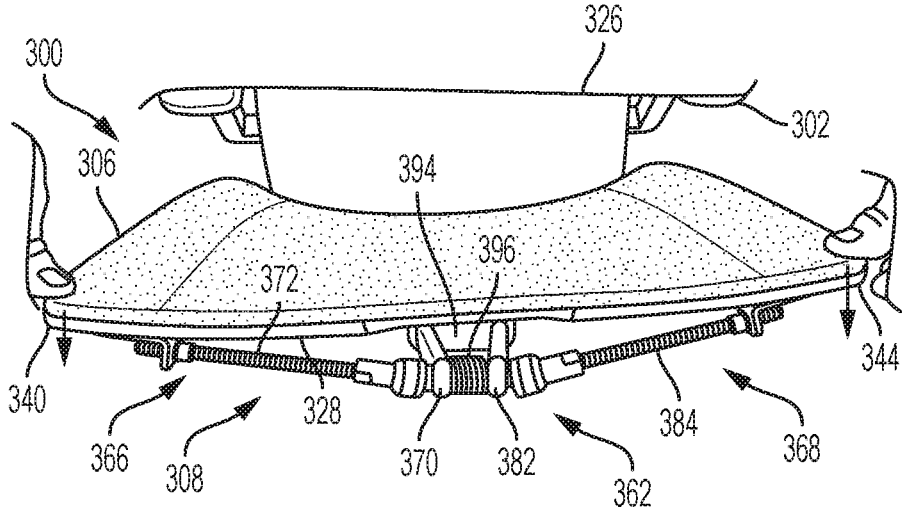
FIG. 21 is a partial top view of the chair of FIG. 17 with forces being applied to the right and left corners of the back of the chair.
Figure 24:
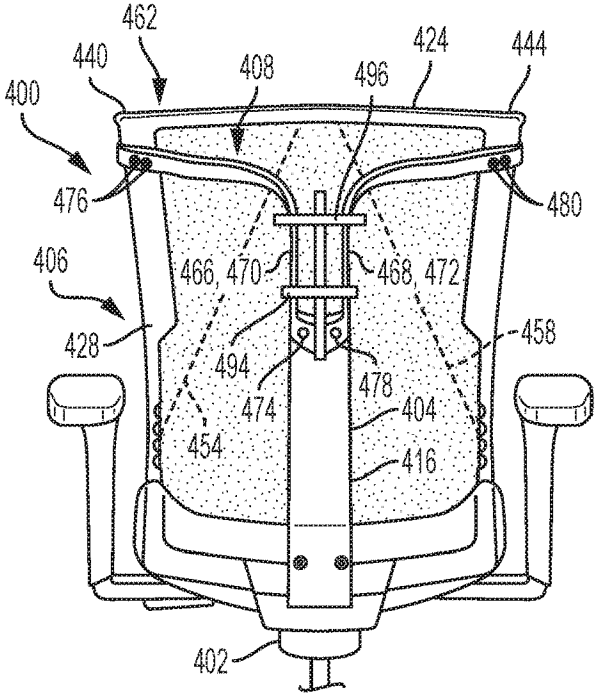
FIG. 24 is a partial rear view of the chair of FIG. 22.
Figure 25:
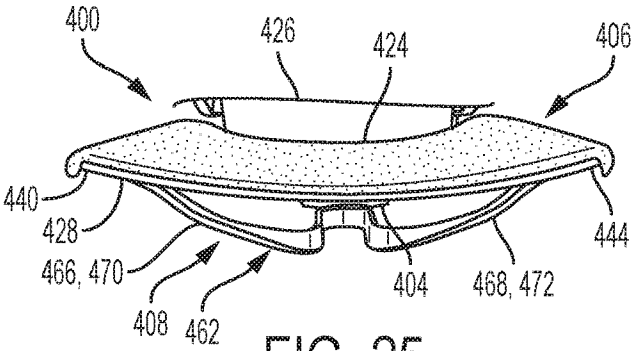
FIG. 25 is a partial top view of the chair of FIG. 22.
Figure 23:
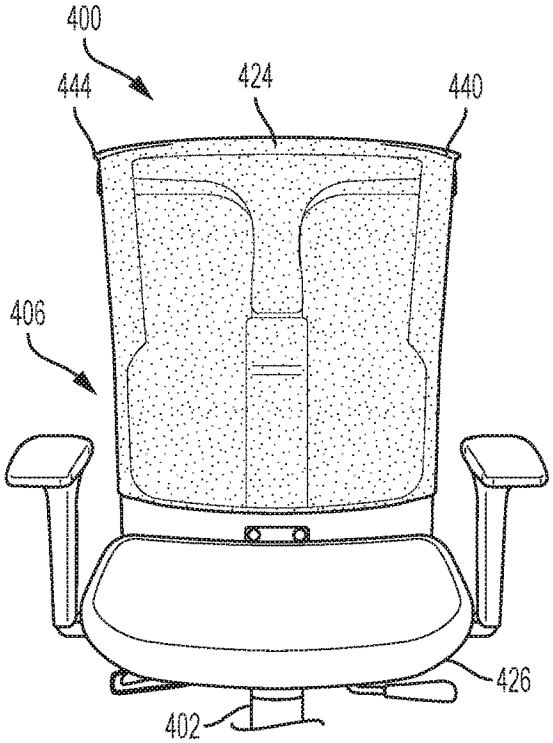
FIG. 23 is a partial front view of the chair of FIG. 22.
Figure 22:
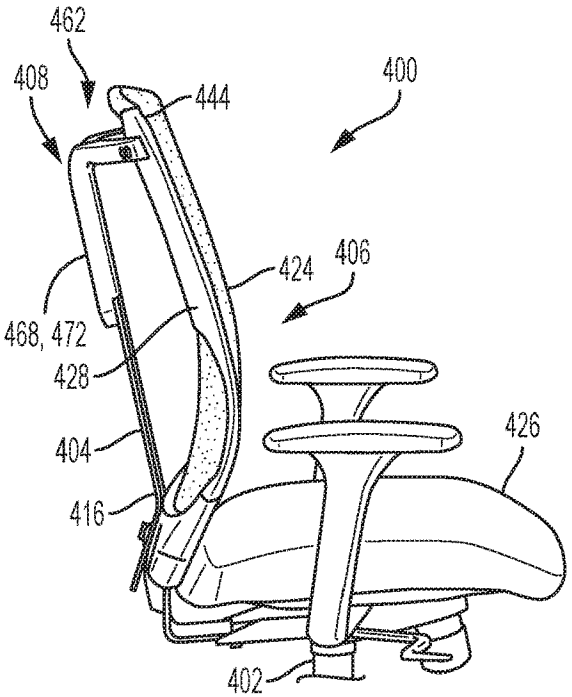
FIG. 22 is a partial side view of another chair, according to some embodiments of the present disclosure.
Figure 29:
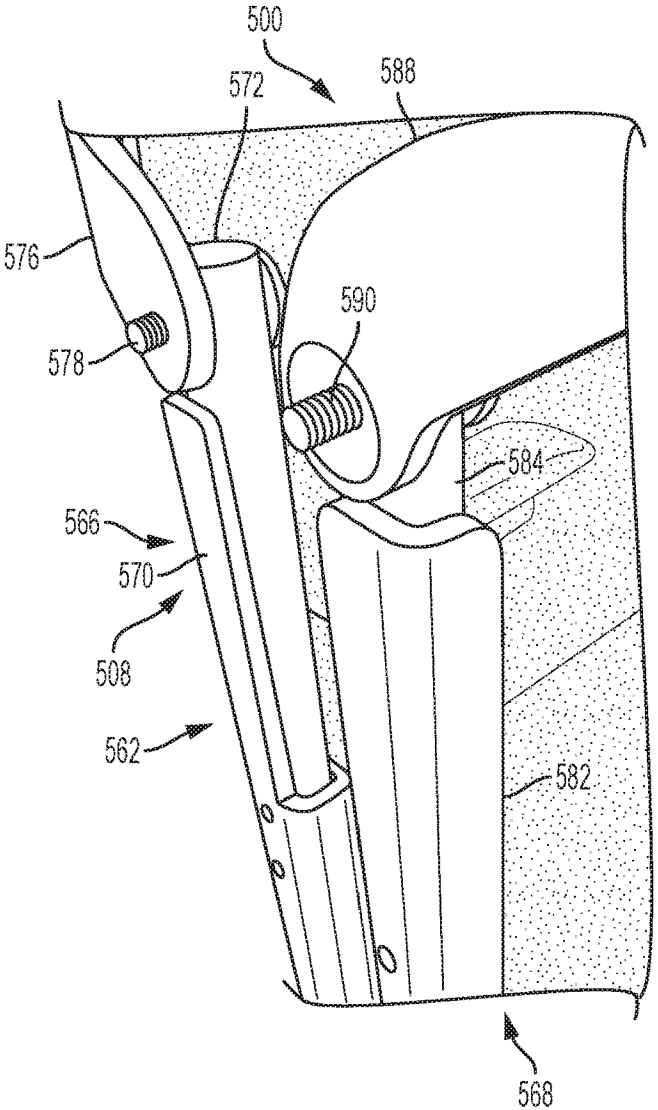
FIG. 29 is a partial perspective view of the chair of FIG. 26.
Figure 27:
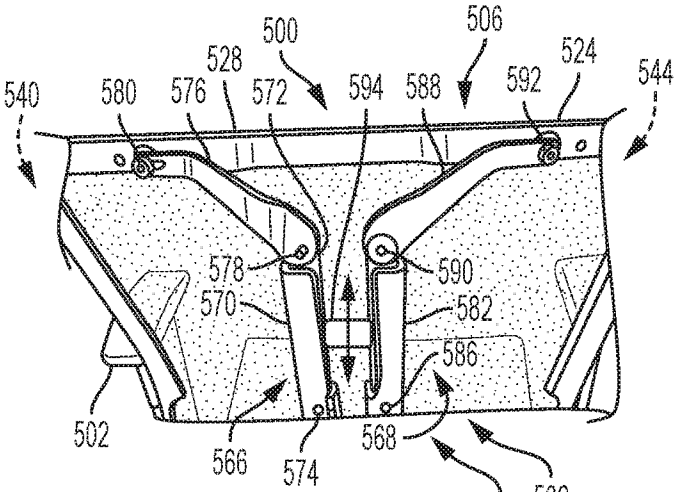
FIG. 27 is a partial back view of the chair of FIG. 26.
Figure 28:
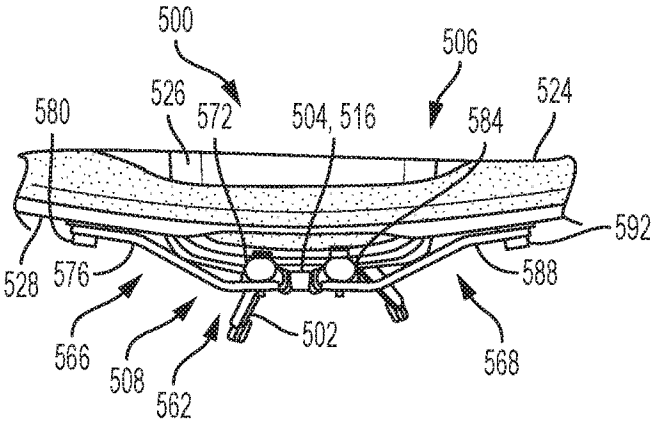
FIG. 28 is a partial top view of the chair of FIG. 26.
Figure 26:
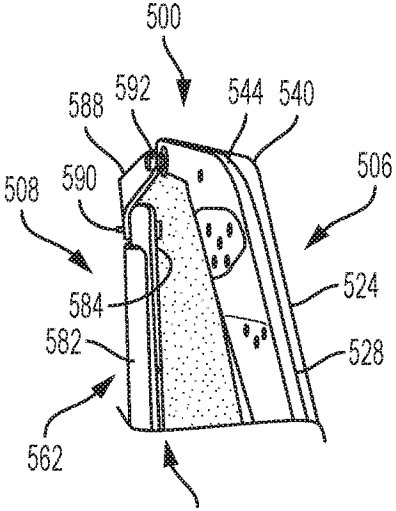
FIG. 26 is a partial side view of another chair, according to some embodiments of the present disclosure.

FIGS. 19-21 illustrate examples of how the flexible frame 328 facilitates both substantially independent and simultaneous movement of different portions thereof. More specifically, FIG. 19 illustrates a relatively small force being applied to the second corner 344, similar to an occupant slightly leaning laterally to the right. As a result, the second corner 344 has moved while the first corner 340 has remained substantially stationary although the first corner 340 may move in a forward direction in such situations according to some designs. FIG. 20 illustrates a relatively large force being applied to the first corner 340, similar to an occupant leaning laterally to the left. As a result, the first corner 340 has moved while the second corner 344 has moved forward relative to the support spine 304, although the second corner 344 may remain substantially stationary according to some designs. FIG. 21 illustrates relatively large forces being applied to the first corner 340 and the second corner 344, similar to an occupant being seated in a reclined posture. As a result, both the first corner 340 and the second corner 344 have moved relative to the support spine 304.

In some embodiments, the resistance assembly 308 could additionally or alternatively include a lower portion (not shown) having substantially the same or similar components as the upper portion 362 for controlling movement of the seat 326.

FIGS. 22-25 illustrate another chair 400 according to some embodiments of the present disclosure. Generally, the chair 400 includes a base 402 and a seat assembly 406, which may be the same as or similar to the base 102 and the seat assembly 106 described above, respectively. The chair 400 also includes a support spine 404, which may be the same as or similar to the support spine 104 described above, except that a back portion 416 of the support spine 404 may be relatively short compared to the back portion 116 described above. Additionally, the chair 400 includes a resistance assembly 408 that causes the flexible frame 428 to bear against, and thereby support, the occupant in various postures and during various movements as described above. The resistance assembly 408 includes several different components than the resistance assembly 108 described above.

Still referring to FIGS. 22-25, an upper portion 462 of the resistance assembly 408 generally includes a left portion 466 that couples the support spine 404 to the seat assembly 406 at or near the first corner 440 and a right portion 468 that couples the support spine 404 to the seat assembly 406 at or near the second corner 444. In some embodiments, the left portion 466 and the right portion 468 are configured to apply forces to the back 424 independently of each other. The left portion 466 and the right portion 468 are generally defined by a first flexible arm 470 and a second flexible arm 472, respectively. The first flexible arm 470 fixedly couples to the support spine 404 (for example, via a fastener 474, welding, or the like) and the flexible frame 428 at or near the first corner 440 (for example, via one or more fasteners 476, welding, or the like). The second flexible arm 472 fixedly couples to the support spine 404 (for example, via a fastener 478, welding, or the like) and the flexible frame 428 at or near the second corner 444 (for example, via one or more fasteners 480, welding, or the like). The first flexible arm 470 and the second flexible arm 472 may be relatively thin and flat components having general dog legged shapes as viewed from the front and the back 424 (see FIGS. 23 and 24). The flexible arms 470 and 472 may together carry a stiffness adjustment component 494 (e.g., similar to stiffness adjustment component 394) that is translatable along the arms 470 and 472 in a generally vertical direction to adjust a stiffness of the flexible arms 470 and 472 in use. The chair 400 optionally further includes a limiter 496, or stop, that is optionally slidable vertically along the arms 470 and 472 and which may be used as a secondary stiffener and/or to prevent further deflection beyond a desired limit. For example, the limiter 496 optionally loosely receives the first and second arms 470 and 472 and, upon the arms 470 and 472 deflecting outwardly within the limiter 496 to the boundary of the limiter 496, the first and second arms 470 and 472 exhibit a sharp increase in stiffness or are simply prevented from further outward deflection.

The first flexible arm 470 may have a bending stiffness of 50% or less than a bending stiffness of the flexible frame 428. Such a bending stiffness of the first flexible arm 470 is with respect to the first axis 454 of the back 424. The second flexible arm 472 may have a bending stiffness of 50% or less than a bending stiffness of the flexible frame 428. Such a bending stiffness of the second flexible arm 472 is with respect to the second axis 458 of the back 424.

In some embodiments, the resistance assembly 408 could additionally or alternatively include a lower portion (not shown) having substantially the same or similar components as the upper portion 462 for controlling movement of the seat 426.

FIGS. 26-29 illustrate another chair 500 according to some embodiments of the present disclosure. Generally, the chair 500 includes a base 502 and a seat assembly 506, which may be the same as or similar to the base 102 and the seat assembly 106 described above, respectively. The chair 500 also includes a support spine 504 (see FIG. 28), which may be the same as or similar to the support spine 104 described above, except that a back portion 516 of the support spine 504 may be relatively short compared to the back portion 116 described above. Additionally, the chair 500 includes a resistance assembly 508 that causes the flexible frame 528 to bear against, and thereby support, the occupant in various postures and during various movements as described above. The resistance assembly 508 includes several different components than the resistance assembly 108 described above.

An upper portion 562 of the resistance assembly 508 generally includes a left portion 566 that couples the support spine 504 to the seat assembly 506 at or near the first corner 540 and a right portion 568 that couples the support spine 504 to the seat assembly 506 at or near the second corner 544. In some embodiments, the left portion 566 and the right portion 568 are configured to apply forces to the back 524 independently of each other.

Referring first to the left portion 566, a substantially rigid mounting 570 is fixedly coupled to the support spine 504 (for example, via fasteners, welding, or the like). The substantially rigid mounting 570 fixedly couples to a first leaf spring 572 near the support spine 504 (for example, via a fastener 574, welding, or the like). In some embodiments and as shown in the figures, the leaf spring 572 extends in a generally vertical direction, or in a direction parallel to the general plane of the back 524. In some embodiments and as shown in the figures, the leaf spring 572 may have a generally uniform cross-sectional shape (for example, an oval shape). In some embodiments, the leaf spring 572 has a bending stiffness of 50% or less than a bending stiffness of the flexible frame 528. Such a bending stiffness of the leaf spring 572 is with respect to a transverse axis that is perpendicular to the longitudinal direction of the leaf spring 572 and lying in the general plane defined by the back 524. As described in further detail below, the bending stiffness of the leaf spring 572 may be adjustable. The substantially rigid mounting 570 may have a cross-sectional shape (for example, an L-shaped cross section) that permits the leaf spring 572 to flex toward the second corner 544 when a force is applied to the first corner 540, but inhibit the leaf spring 572 from flexing toward the first corner 540. The leaf spring 572 pivotably couples to a first connecting link 576 (for example, via a one-degree-of-freedom pivot joint, such as joint formed by a fastener 578). The connecting link 576 may have a dog legged shape. The connecting link 576 fixedly couples to the flexible frame 528 at or near the first corner 540 (for example, via one or more fasteners 580, welding, or the like). These components may include various materials, such as metals, polymers, or the like.

In some embodiments and as shown in the figures, the right portion 568 of the upper portion 562 of the resistance assembly 508 is a mirror image of the left portion 566. That is, the right portion 568 includes a substantially rigid mounting 582 that is fixedly coupled to the support spine 504 (for example, via fasteners, welding, or the like). The substantially rigid mounting 582 fixedly couples to a second leaf spring 584 near the support spine 504 (for example, via a fastener 586, welding, or the like). In some embodiments and as shown in the figures, the leaf spring 584 extends in a generally vertical direction, or in a direction parallel to the general plane of the back 524. In some embodiments and as shown in the figures, the leaf spring 584 may have a generally uniform cross-sectional shape (for example, an oval shape). In some embodiments, the leaf spring 584 has a bending stiffness of 50% or less than a bending stiffness of the flexible frame 528. Such a bending stiffness of the leaf spring 584 is with respect to a transverse axis that is perpendicular to the longitudinal direction of the leaf spring 584 and lying in the general plane defined by the back 524. As described in further detail below, the bending stiffness of the leaf spring 584 may be adjustable. The substantially rigid mounting 582 may have a cross-sectional shape (for example, an L-shaped cross section) that permits the leaf spring 584 to flex toward the first corner 540 when a force is applied to the second corner 544, but inhibit the leaf spring 584 from flexing toward the second corner 544. The leaf spring 584 pivotably couples to a second connecting link 588 (for example, via a one-degree-of-freedom pivot joint, such as joint formed by a fastener 590). The connecting link 588 may have a dog legged shape. The connecting link 588 fixedly couples to the flexible frame 528 at or near the first corner 540 (for example, via one or more fasteners 592, welding, or the like). These components may include various materials, such as metals, polymers, or the like.

As described above, the leaf springs 572 and 584 may have adjustable bending stiffnesses. To facilitate such adjustment, the leaf springs 572 and 584 may together carry an adjustment component 594 that is translatable along the leaf springs 572 and 584 in a generally vertical direction. Translation of the adjustment component 594 along the leaf springs 572 and 584 varies the length of the leaf springs 572 and 584 that flexes in response to forces applied to the back 524, which in turn varies the bending stiffnesses of the leaf springs 572 and 584. The adjustment component 594 may include various materials, such as metals, polymers, or the like.

In some embodiments, the resistance assembly 508 could additionally or alternatively include a lower portion (not shown) having substantially the same or similar components as the upper portion 562 for controlling movement of the seat 526.

Figure 30:
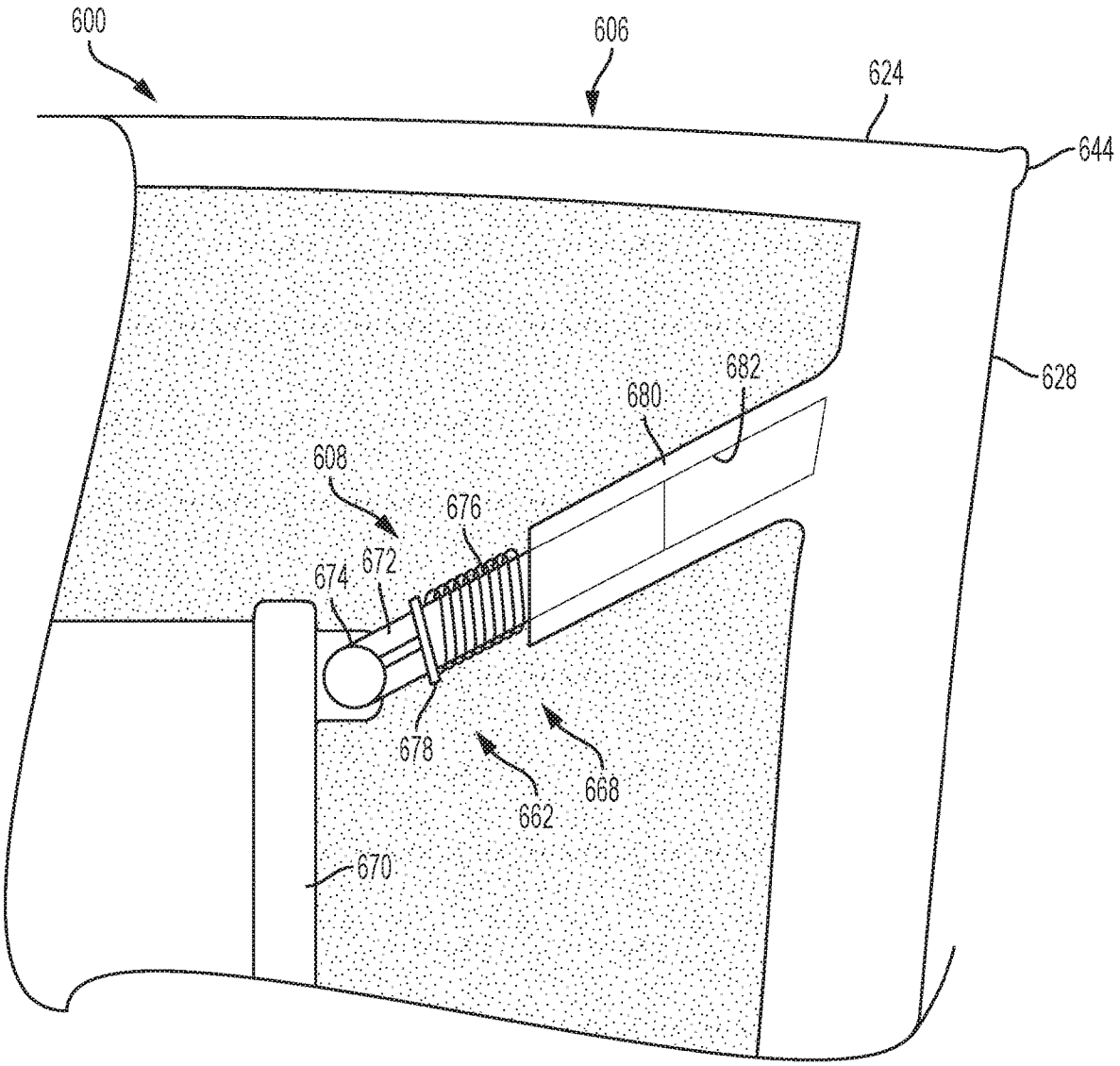
FIG. 30 is a partial back view of another chair, according to some embodiments of the present disclosure.

FIG. 30 illustrates yet another chair 600 according to some embodiments of the present disclosure. Generally, the chair 600 includes a base (not shown) and a seat assembly 606, which may be the same as or similar to the base 102 and the seat assembly 106 described above, respectively. The chair 600 also includes a support spine (not shown), which may be the same as or similar to the support spine 104 described above, except that a back portion of the support spine (not shown) may be relatively short compared to the back portion 116 described above. Additionally, the chair 600 includes a resistance assembly 608 that causes the flexible frame 628 to bear against, and thereby support, the occupant in various postures and during various movements as described above. The resistance assembly 608 includes several different components than the resistance assembly 108 described above.

An upper portion 662 of the resistance assembly 608 generally includes a left portion (not shown) that couples the support spine to the seat assembly 606 at or near the first corner (not shown) and a right portion 668 that couples the support spine to the seat assembly 606 at or near the second corner 644. In some embodiments, the left portion and the right portion 668 are configured to apply forces to the back 624 independently of each other.

The right portion 668 includes a substantially rigid mounting 670 that is fixedly coupled to the support spine (for example, via fasteners, welding, or the like). The substantially rigid mounting 670 pivotably couples to a first connecting link 672 (for example, via a three-degree-of-freedom joint, such as a ball and socket joint 674). The first connecting link 672 carries a compression spring 676 and a stop 678. The compression spring 676 is compressed between the stop 678 and a second connecting link 680 that is translatably coupled to the first connecting link 672 (for example, by receiving the first connecting link 672 in an internal chamber 682). As such, the compression spring 676 urges the second connecting link 680 to translate relative to the first connecting link 672. Opposite the first connecting link 672, the second connecting link 680 couples to the flexible frame 628 at or near the second corner 644 (for example, monolithically, via one or more fasteners, welding, or the like).

In some embodiments, the left portion of the upper portion 662 of the resistance assembly 608 is a mirror image of the right portion 668. In some embodiments, the resistance assembly 608 could additionally or alternatively include a lower portion (not shown) having substantially the same or similar components as the upper portion 662 for controlling movement of the seat (not shown).

Figure 31:
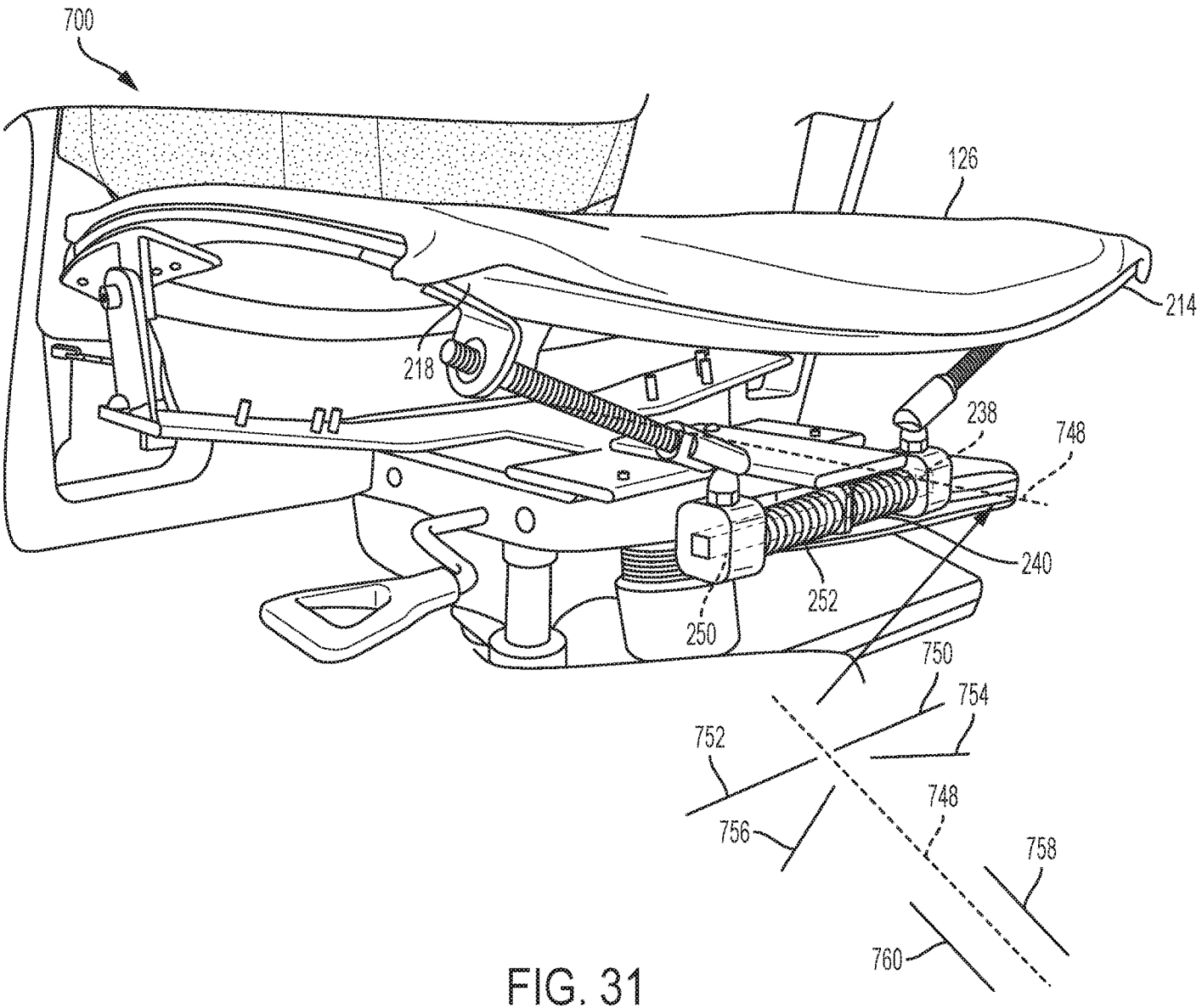
FIG. 31 is a partial lower front perspective view of yet another chair, according to some embodiments of the present disclosure.

FIG. 31 illustrates yet another chair 700 according to some embodiments of the present disclosure. Generally, the chair 700 includes the same components as the chair 100 described above. FIG. 31 also illustrates alternative orientations of the rods 238 and 250 and the compression springs 240 and 252 that require different loads to displace one or both of the corners 214 and 218 of the seat 126. Such orientations are in a transverse plane that includes a central axis 748, which is horizontal and lies in the sagittal plane 156 (see FIGS. 2 and 3). For the chair 700 (and the chair 100), the rod 238 and the compression spring 240 are oriented in the direction represented by line 750, and the rod 250 and the compression spring 252 are oriented in the direction represented by line 752 (that is, perpendicular to the central axis 748). In other embodiments, the rod 238 and the compression spring 240 are oriented in the direction represented by line 754, and the rod 250 and the compression spring 252 are oriented in the direction represented by line 756 (that is, extending forward in the transverse plane at a non-orthogonal, acute angle relative to the central axis 748). In other embodiments, the rod 238 and the compression spring 240 are oriented in the direction represented by line 758, and the rod 250 and the compression spring 252 are oriented in the direction represented by line 760 (that is, parallel to the central axis 748).

When the springs are angled perpendicularly per 750, 752 the forces on the springs are more apt to individually compress the springs corresponding to where the force is applied. If the force is moved forward to the front edge of the seat the springs generally resist deformation to a greater extent than if the force is applied more rearwardly of the springs.

As the springs are angled more forward toward 754, 756 the springs are less apt to react to forces on the sides, but proceeding forward to the edge of the seat the springs become more reactive.

At 758, 760, the springs are least reactive when sitting back on seat and more reactive when moving to the edge of the seat. As the springs are angled forward, they become more responsive to forces applied to the edges of the seat.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A chair, comprising:

a support spine;

a seat assembly coupled to the support spine, the seat assembly comprising:

a flexible frame being movable relative to the support spine, the flexible frame comprising a first frame element, a second frame element coupled to the first frame element at a first corner, and a third frame element coupled to the second frame element at a second corner, the first corner and the second corner being substantially independently movable relative to the support spine;

a conformable panel coupled to the flexible frame and configured to engage an occupant of the chair; and a resistance assembly coupling the support spine to the flexible frame, the resistance assembly bearing against the flexible frame to facilitate substantially independent movement of the first corner and the second corner relative to the support spine, the resistance assembly comprising:

a compression spring;

a slider translatably coupled to the support spine, the slider being urged to translate relative to the support spine by the compression spring; and a connecting link pivotably coupled to the slider and coupled to the flexible frame.

2. The chair of claim 1, wherein the second frame element comprises a flexible section disposed between the first corner and the second corner, wherein the flexible section is a second flexible section, and the first frame element comprises a first flexible section and the third frame element comprises a third flexible section.

3. The chair of claim 1, wherein the seat assembly comprises a back configured to engage the back of the occupant, the back of the seat assembly comprising the flexible frame and the conformable panel.

4. The chair of claim 1, wherein the seat assembly comprises a seat configured to engage the legs of the occupant, the seat comprising the flexible frame and the conformable panel.

5. A chair, comprising:

a support spine;

a seat assembly coupled to the support spine, the seat assembly comprising:

a flexible frame being movable relative to the support spine, the flexible frame comprising a first frame element, a second frame element coupled to the first frame element at a first corner, and a third frame element coupled to the second frame element at a second corner, the first corner and the second corner being substantially independently movable relative to the support spine;

a conformable panel coupled to the flexible frame and configured to engage an occupant of the chair; and a resistance assembly coupling the support spine to the flexible frame, the resistance assembly bearing against the flexible frame to facilitate substantially independent movement of the first corner and the second corner relative to the support spine, wherein the resistance assembly comprises:

a compression spring;

a first connecting link pivotably coupled to the support spine; and a second connecting link translatably coupled to the first connecting link and coupled to the flexible frame, the second connecting link being urged to translate relative to the first connecting link by the compression spring.

6. The chair of claim 5, wherein the second frame element comprises a flexible section disposed between the first corner and the second corner, wherein the flexible section is a second flexible section, and the first frame element comprises a first flexible section and the third frame element comprises a third flexible section.

7. The chair of claim 5, wherein the seat assembly comprises a back configured to engage the back of the occupant, the back of the seat assembly comprising the flexible frame and the conformable panel.

8. The chair of claim 5, wherein the seat assembly comprises a seat configured to engage the legs of the occupant, the seat comprising the flexible frame and the conformable panel.

* * * * *